US008485622B2

(12) United States Patent
Ogasawara et al.

(10) Patent No.: US 8,485,622 B2
(45) Date of Patent: Jul. 16, 2013

(54) PRINTING SYSTEM AND PROGRAM

(75) Inventors: Naoki Ogasawara, Matsumoto (JP); Ryohei Ito, Shiojiri (JP); Shuichi Koganehira, Matsumoto (JP); Masaharu Iwamoto, Shiojiri (JP); Daisuke Nagai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 11 days.

(21) Appl. No.: 13/215,136

(22) Filed: Aug. 22, 2011

(65) Prior Publication Data

US 2012/0044285 A1 Feb. 23, 2012

(30) Foreign Application Priority Data

Aug. 23, 2010 (JP) ..... 2010-185849

(51) Int. Cl.
*B41J 2/195* (2006.01)

(52) U.S. Cl.
USPC ..... 347/7; 347/19

(58) Field of Classification Search
USPC ..... 347/5, 6, 7, 14, 17, 19, 84–87
See application file for complete search history.

(56) References Cited

U.S. PATENT DOCUMENTS

| | | | | |
|---|---|---|---|---|
| 6,460,982 | B1 | 10/2002 | Ito et al. | |
| 7,077,513 | B2 * | 7/2006 | Kimura et al. | 347/85 |
| 7,231,166 | B2 | 6/2007 | Miyaji | |

FOREIGN PATENT DOCUMENTS

| | | | |
|---|---|---|---|
| JP | 11-237816 | A | 8/1999 |
| JP | 2000-211155 | A | 8/2000 |
| JP | 2002-036527 | A | 2/2002 |
| JP | 2003-326752 | A | 11/2003 |
| JP | 2005-288878 | A | 10/2005 |

* cited by examiner

*Primary Examiner* — Juanita D Jackson
(74) *Attorney, Agent, or Firm* — Kilpatrick Townsend & Stockton LLP

(57) ABSTRACT

If an ink amount supplied from an ink tank to an ejection head reaches a predetermined limit value, ink ejection is not permitted. If initialization data are input and the input initialization data are appropriate, a count value of the ink amount is initialized, and the ink ejection is started again. In addition, the initialization data which is input once and determined to be appropriate is determined to be inappropriate thereafter. By doing so, although ink of which the property and state are inappropriate is used for the refilling, since appropriate initialization data may not be input, it is possible to avoid the inappropriate ink from being used for the refilling.

5 Claims, 12 Drawing Sheets

PRINTING SYSTEM AND PROGRAM

BACKGROUND

1. Technical Field

The present invention relates to a technique for printing an image by ejecting ink from an ejection head.

2. Related Art

A printing apparatus such an ink jet printer which prints an image by ejecting ink from an ejection head has been widely used. Ink which is to be ejected is contained in a dedicated container which is called an ink cartridge. The ink is supplied to an ejection head by the weight of the ink itself or a transmitting pump.

The ejection head has a complicated structure so that fine ejection nozzles for ejecting ink and narrow ink passages for guiding the ink to the ejection nozzles are formed in an inner portion of the ejection head. Therefore, if the ink having an inappropriate property and state is supplied, the ejection nozzle or the ink passage may be clogged, so that finally it is necessary to replace the ejection head. Accordingly, in order to avoid the ink which is not appropriate from being supplied, a memory such as an IC chip is mounted on the ink cartridge, and authentication data are stored therein. By doing so, if the ink cartridge is mounted on the printing apparatus, the authentication data stored in the memory are read out, and it is determined whether or not the ink cartridge is a genuine product. If the ink cartridge is a genuine product, it may be determined that the ink of the inner portion thereof is ink having the appropriate property and state (refer to JP-A-11-237816).

In addition, since the ink cartridge has a limitation in the amount of ink contained, in the case of mass printing, the printing may be stopped several times so as to replace the ink cartridge. Therefore, there is a technique where the ink is supplied from an ink tank provided to the printing apparatus and, if the ink is reduced during the printing, the ink is refilled from a separately prepared ink bottle to the ink tank, so that the printing may be continuously performed (refer to JP-A-2000-211155).

However, in the technique capable of performing continuous printing by refilling ink from the ink bottle or the like, the following problems may occur. First, it may not be determined whether or not the ink used for refilling the ink tank is the ink having the appropriate property and state. Therefore, an inappropriate ink is supplied, so that clogging occurs in an inner portion of the ejection head. There may be a problem in that it is necessary to replace the ejection head. In addition, even in the case of the appropriate ink (recommended ink) of which the use is recommended by a maker of the printing apparatus, once the ink bottle is opened, the property and state of the ink are deteriorated as time elapses. Accordingly, if the ink which is deteriorated due to the elapse of a long time from the opening is used for the refilling, even in the case where the refilled ink is a recommended ink, an inner portion of the ejection head may be clogged.

SUMMARY

An advantage of some aspects of the invention is to provide a technique capable of performing continuous printing by refilling ink from an ink bottle or the like and capable of preventing an inner portion of an ejection head from being clogged due to the refilling of inappropriate ink or deteriorated ink.

According to an aspect of the invention, there is provided a program having the following configuration. In other words, in the program for controlling operations of a printing apparatus by using a computer, the printing apparatus having an ink tank capable of being refilled with ink from an external portion and an ejection head of ejecting ink supplied from the ink tank, the printing apparatus having a function of stopping ink ejection from the ejection head if a count value of an ink amount supplied from the ink tank to the ejection head reaches a predetermined limit value, wherein the program embodies, by using the computer, functions including: a first function of acquiring, from the printing apparatus, information capable of at least determining whether or not the count value of the ink amount reaches the limit value; a second function of receiving an input of initialization data which are data for initializing the count value of the ink amount in the case where the count value of the ink amount reaches the limit value; and a third function of determining whether or not the input initialization data are appropriate, initializing the count value of the ink amount in the printing apparatus if the initialization data are determined to be appropriate, and storing the initialization data which are determined to be appropriate as inappropriate initialization data.

The program according to the invention has a function of controlling the operation of the printing apparatus having a function of stopping the ink ejection, when the count value of the ink amount reaches the predetermined limit value, as follows. First, information from which it may be determined whether or not the count value of the ink amount reaches the limit value is acquired from the printing apparatus. Herein, when the ink amount in the printing apparatus is to be counted, although the ink amount may be counted by directly measuring the flow rate of the ink supplied to the ejection head, the ink amount supplied to the ejection head may be counted from the operation of the ejection head ejecting the ink. In addition, with respect to the aspect of the counting of the ink amount, the ink amount may be counted in an aspect where the count value is increased as the ink is supplied to the ejection head, and on the contrary, in an aspect where the count value is decreased. In addition, in the program according to the invention, the information from which it may be determined whether or not the count value of the ink amount reaches the limit value is acquired from the printing apparatus is sufficient. Therefore, the count value of the ink amount may be acquired, or information indicating a relationship in magnitude between the count value of the ink amount and the limit value or information indicating only whether or not the count value of the ink amount reaches the limit value may be acquired. Next, if the count value of the ink amount is determined to reach the predetermined limit value, the initialization data is set to an inputtable state. Herein, the initialization data denote the data for initializing the count value of the ink amount in the printing apparatus. Furthermore, if the initialization data are input, it is determined whether or not the data are appropriate, and if the data are determined to be appropriate, the count value of the ink amount in the printing apparatus is initialized. As a result, the printing apparatus becomes in the ink ejectable state again. In addition, the initialization data which are determined to be appropriate are stored so as to be determined to be inappropriate initialization data thereafter.

By doing so, after the ink in the ink tank is decreased so that the ink ejection is stopped, although the ink tank is refilled with the ink, the ink ejection from the printing apparatus is not started again unless the appropriate initialization data are input. Accordingly, for example, similarly to the case where a label where the appropriate initialization data are printed is attached to only the genuine product of the ink bottle, if the appropriate initialization data may be recognized only in the case where the ink having an appropriate property and state is received, although the ink having an inappropriate property and state is used for the refilling, the ink ejection may not be started again. Therefore, it is possible to avoid an inner portion of the ejection head from being clogged due to the ink having an inappropriate property and state. In addition, the initialization data which are used once are stored as inappropriate initialization data, so that the initialization data may not be used. Therefore, in the case where the ink in the ink tank is decreased so that the ink ejection is stopped again, the ink having the appropriate property and state is to be newly received. As a result, it is possible to avoid an inner portion of the ejection head from being clogged due to the ink having an inappropriate property and state. In addition, since the initialization data may be used only one time, the ink is to be used for the refilling without remaining ink if possible. Therefore, it is possible to avoid the ejection head from being clogged by the refilling of the ink which is deteriorated due to the elapse of time without the refilling from the opening irrespective of whether or not the ink has an appropriate property and state at the acquisition time.

In addition, if the ink tank is configured so as to be refilled with the ink only in the case where the count value of the ink amount reaches the predetermined value, it is possible to securely avoid the ejection head from being clogged by the refilling of the ink which is deteriorated due to the elapse of time from the opening irrespective of whether or not the ink having an appropriate property and state is acquired. In other words, for example, it may be considered that, after an appropriate ink is acquired, the ink tank is refilled with a half of the ink, and the other half thereof is not used for the refilling but remains. In this case, until the count value of the ink amount which is initialized by inputting the initialization data reaches the predetermined limit value, the ink which is not used for the refilling but remains may not be used for the refilling. Next, after the count value of the ink amount reaches the limit value, the initialization data of the remaining ink may not be used, so that the ink having an appropriate property and state is to be newly acquired. As a result, the ink which is not used for the refilling but remains is not used. Therefore, it is possible to avoid the ejection head from being clogged by the ink which is not used for refilling the ink tank but is deteriorated. In addition, since the ink which is not used for the refilling but remains may not be used, the entire ink which is acquired is to be used for the refilling. As a result, it is possible to avoid the occurrence of the ink which is not used for the refilling after the opening but is deteriorated.

In addition, in the aforementioned program according to the invention, if the count value of the ink amount reaches a predetermined limit value, the function for receiving the input of the initialization data may be embodied as follows. First, if the count value of the ink amount reaches the limit value, a predetermined checking image (the image for allowing the manipulator of the printing apparatus to check whether or not the refilling of the ink tank with ink is performed) is displayed. After that, in the case where it is detected that the performing the ink refilling is instructed by the manipulator of the printing apparatus, a predetermined input image for allowing the manipulator to input the initialization data may be displayed.

By doing so, in the case where the manipulator of the printing apparatus does not desire to refill the ink tank with the ink, the input image for inputting the initialization data is not displayed. Therefore, it is possible to prevent the manipulator from performing an erroneous operation.

In addition, in the aforementioned program according to the invention, the following operations may be performed. First, a plurality of ink tanks are mounted on the printing apparatus, and an ejection head is installed with respect to each of the ink tanks. Next, when the ink amount is to be counted, the ink amount of each of the ink tanks is counted. If the count value of the ink amount in any one of the ink tanks reaches a limit value, a checking image (the image for allowing the manipulator of the printing apparatus to check whether or not the refilling of the ink tank with ink is performed) with respect to the ink tank is displayed. As a result, an input image for allowing the manipulator of the printing apparatus to input the initialization data with respect to the ink tank of which the ink refilling is indicated to be performed may be displayed.

By doing so, even in the printing apparatus for printing an image by using a plurality of types of ink, an input image for inputting the initialization data with respect to only the ink which is to be used for the refilling by the manipulator is displayed. Therefore, even in the printing apparatus where a plurality of the types of ink are mounted, it is possible to prevent the problem that the manipulator performs an erroneous operation.

In addition, as described above, in the program according to the invention where a plurality of the ink tanks are mounted on the printing apparatus and an ejection head is installed with respect to each of the ink tanks, the ink of different colors may be contained in the plurality of the ink tanks, and the initialization data including color information of the ink may be input.

By doing so, when the ink tank is refilled with the ink, in the case where ink of an inappropriate color is used for the refilling, the initialization data are determined to be inappropriate. Therefore, it is possible to avoid printing from being started in the state where the ink of an inappropriate color is used for the refilling.

In addition, the aspect of the aforementioned invention may also considered to be a printing apparatus of which operations are controlled by the program or a printing system which is configured with a computer which executes the program. Alternatively, the aspect of the aforementioned invention may also be considered to be a printing system where the program is combined with a printing apparatus. According to another aspect of the invention, there is provided a printing system having a printing unit which ejects ink refilled from an external portion into an ink tank by using an ejection head and a controller which controls operations of the printing unit, wherein the controller includes: an ink amount counting means for counting an ink amount supplied from the ink tank to the ejection head in the printing unit; a means for storing an accumulated amount of remaining ink or a consumed ink amount of the ink tank counted by the ink amount counting means as a count value of the ink amount; an ejection stopping means for stopping the ink ejection from the ejection head if the count value of the ink amount reaches a predetermined limit value; an initialization data receiving means for receiving an input of initialization data for initializing the count value of the ink amount if the count value of the ink amount reaches the limit value; and an initialization data determining means for determining whether or not the input initialization data are appropriate, initializing the count value of the ink amount if the initialization data are determined to be appropriate, and storing the initialization data which are determined to be appropriate as inappropriate initialization data.

In the printing system according to the invention, the ink amount supplied from the ink tank to the ejection head is counted, and if the count value reaches a predetermined limit value, the ink ejection from the ejection head is stopped, so that the initialization data may be input. Next, if the input initialization data are determined to be appropriate, since the count value of the ink amount which reaches the limit value is initialized, the ink ejection from the ejection head may be performed again. In addition, the initialization data which are determined to be appropriate are determined to be inappropriate initialization data thereafter. In addition, in the case where the printing apparatus is connected to a computer for controlling the printing apparatus and an image is printed, among the computer connected to the printing apparatus and the controller mounted on the printing apparatus, a portion having a function of counting the ink amount and stopping the ink ejection from the ejection head if the count value reaches the predetermined limit value corresponds to the controller of the invention, and a portion which does not correspond to the controller of the invention among the printing apparatus corresponds to the printing unit of the invention. In addition, in the case where a computer is mounted on the printing apparatus and an image is printed without connection to an external computer, the computer mounted on the printing apparatus corresponds to the controller of the invention, and the other portions correspond to the printing unit of the invention.

Similarly to the aforementioned program according to the invention, in the aforementioned printing system according to the invention, since the ink supplying may not be started again although the ink having an inappropriate property and state is used for the refilling, it is possible to avoid an inner portion of the ejection head from being clogged by the ink having an inappropriate property and state. In addition, since the initialization data which are used once may not be used, in order to refill the ink tank with the ink, the ink having an appropriate property and state is necessarily acquired every time. As a result, it is possible to avoid an inner portion of the ejection head from being clogged the ink having an inappropriate property and state. In addition, since the initialization data may be used only one time, the ink is to be used for the refilling without remaining ink if possible. Therefore, it is possible to avoid the ejection head from being clogged by the refilling of the ink which is deteriorated due to the elapse of time without the refilling from the opening irrespective of whether or not the ink has an appropriate property and state at the acquisition time.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, in order to clarify contents of the aforementioned invention, embodiments will be described in the following order.

A. Configuration of Apparatus:
A-1. Structure of Ink Jet Printer According to Embodiment:
A-2. Configuration of printing system According to Embodiment:
B. Remaining Ink Amount Management Process:
B-1. Remaining Ink Amount Correcting Process:
B-2. Ink Refilling Process:
C. Modified Examples:
C-1. First Modified Example:
C-2. Second Modified Example:
C-3. Third Modified Example:
C-4. Fourth Modified Example:

A. Configuration of Apparatus

Figure 1:
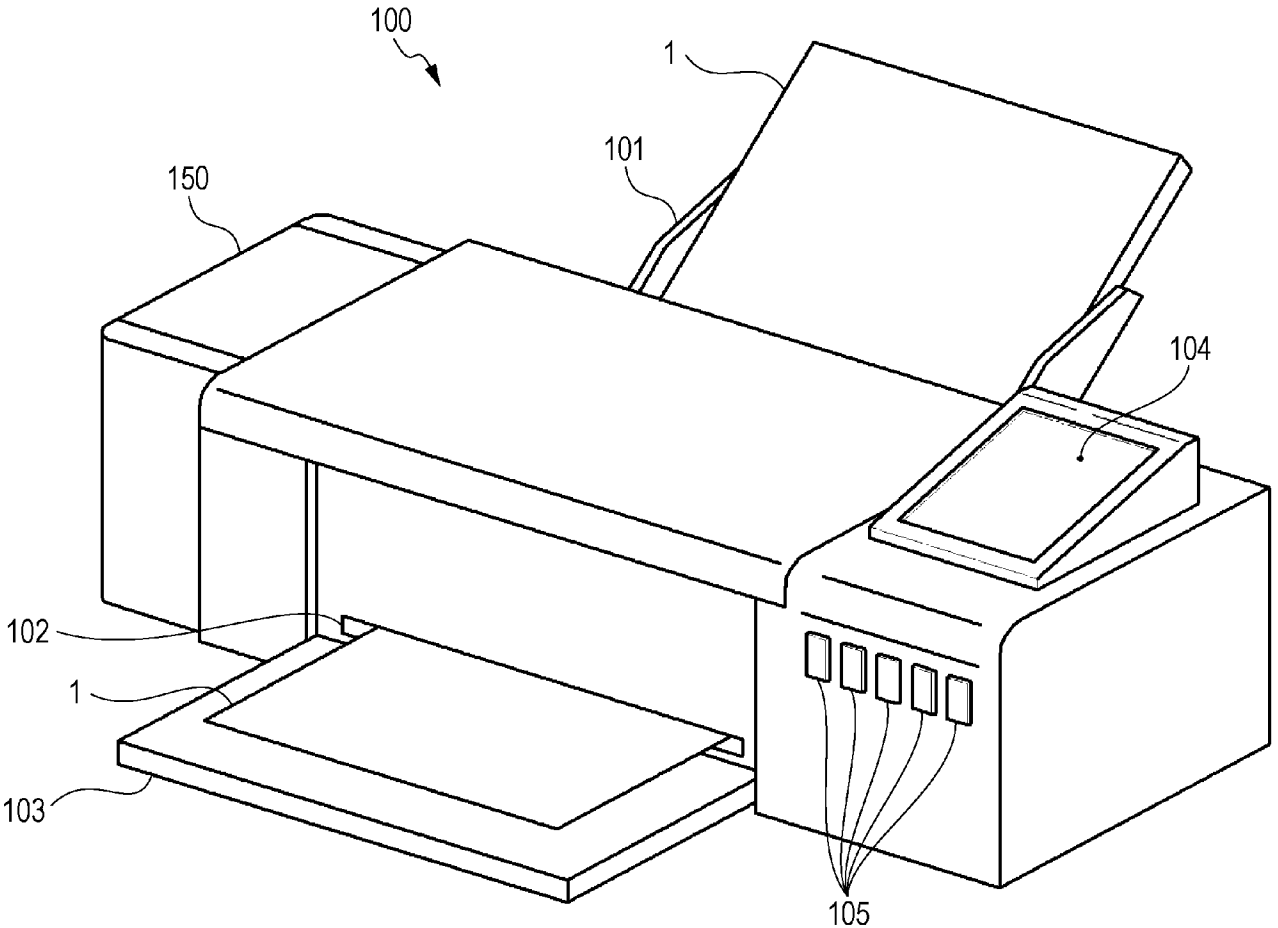
FIG. 1 is a diagram illustrating an example of an ink jet printer as a printing apparatus according to an embodiment of the invention.

A-1. Structure of Ink Jet Printer According to Embodiment:

FIG. 1 is a diagram illustrating an example of an ink jet printer 100 as a printing apparatus according to an embodiment of the invention. The ink jet printer 100 illustrated has outer appearance of a substantially box shape, and a front cover 103 is disposed at a substantially central portion of the front surface of the ink jet printer 100, and a feed tray 101 where a printing paper 1 is set is disposed in the rear surface side thereof. In addition, in the front surface side of the ink jet printer 100, a plurality of manipulation buttons 105 are disposed at corresponding positions in the vicinity of the front cover 103, and a touch panel type monitor screen 104 is installed on the upper surface side of the positions where the manipulation buttons 105 are disposed. The lower end side of the front cover 103 is supported by a shaft. If the upper end side thereof is laid down forwards, a long and narrow paper discharging hole 102 through which the printing paper 1 is discharged appears. If the printing paper 1 is set on the feed tray 101 and the monitor screen 104 or the manipulation button 105 is manipulated, the printing paper 1 is fed into from the feed tray 101. Next, after an image is printed on the surface of the printing paper 1 inside the ink jet printer 100, the printing paper 1 is discharged from the paper discharging hole 102.

A box-shaped tank case 150 is installed on the side surface of the ink jet printer 100. As described later in detail, a plurality of ink tanks are installed inside the tank case 150, so that the ink which is to be used for printing by the ink jet printer 100 is supplied from the ink tanks.

In addition, data of an image which is to be printed (image data) is subject to an image process in a computer 200 connected to the ink jet printer 100, and after that, the image data are supplied to the ink jet printer 100. If receives the image data which are subject to the image process from the computer 200, the ink jet printer 100 converts the image data into dot data indicating whether or not dots are formed by ink on the printing paper 1 and forms dots by ejecting ink on the printing paper 1 according to the obtained dot data. As a result, the image is printed on the printing paper 1. In other words, in the embodiment, a printing system 10 is configured with the ink jet printer 100 and the computer 200 which performs a predetermined image process on the image data and supplies the image data to the ink jet printer 100.

Figure 2:
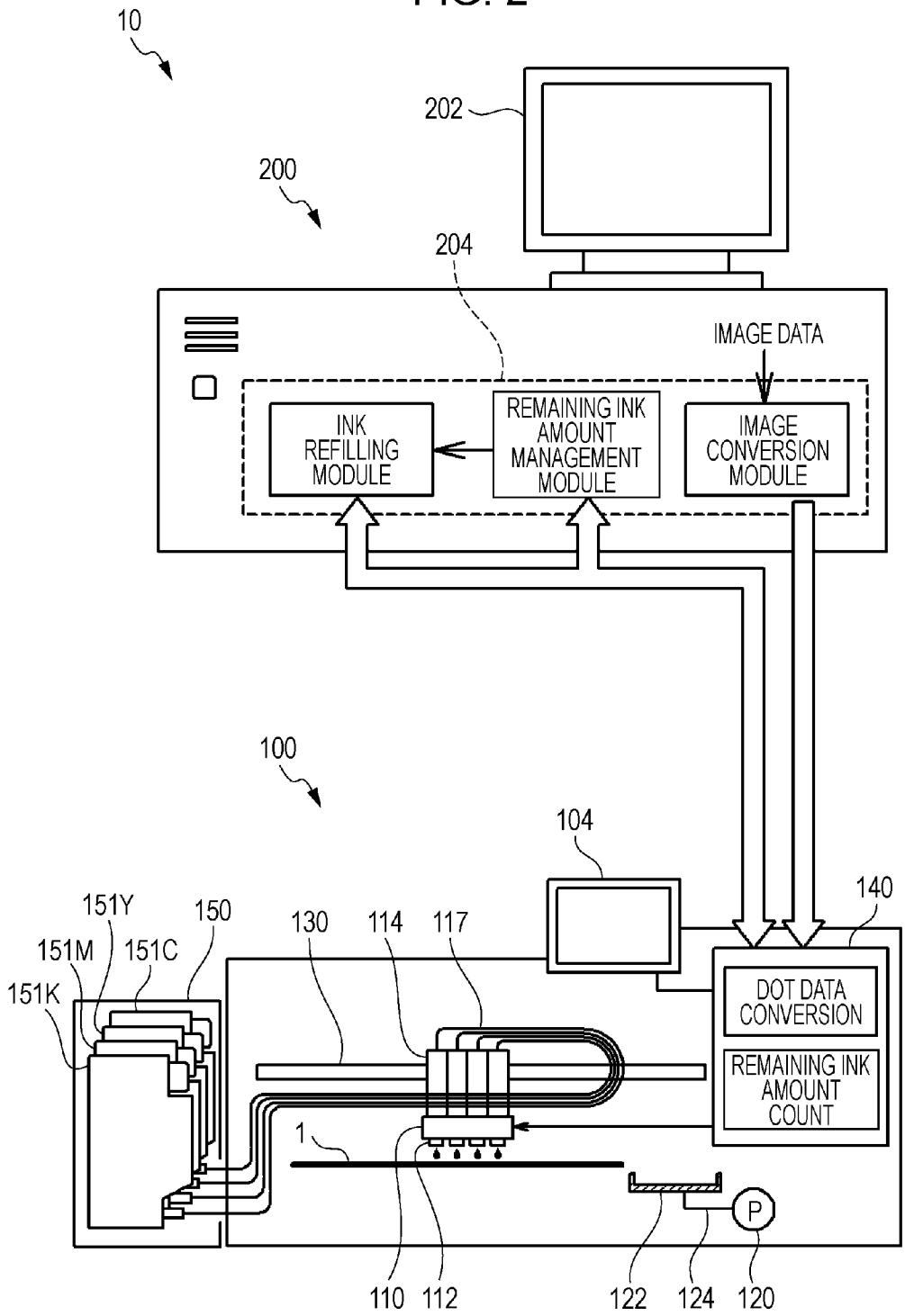
FIG. 2 is a diagram illustrating overall configuration of a printing system according to an embodiment of the invention.

A-2. Configuration of Printing System According to Embodiment:

FIG. 2 is a diagram illustrating overall configuration of the printing system 10 according to the embodiment of the invention. In addition, this figure also illustrates a rough internal structure of the ink jet printer 100. First, the internal structure of the ink jet printer 100 is described in brief. As illustrated in FIG. 2, the carriage 110 which performs reciprocating movement on the printing paper 1 is installed inside the ink jet printer 100, and the ejection head 112 which ejects ink is installed in the carriage 110. In the ink jet printer 100 according to the embodiment, an image may be printed by using ink of four colors of cyan (hereinafter, referred to as C), yellow (hereinafter, referred to as Y), magenta (hereinafter, referred to as M), and black (hereinafter, referred to as K), and the ejection head 112 is installed corresponding to each of the colors of ink.

The carriage 110 is driven by a driving mechanism (not shown), so that the carriage 110 repetitively performs reciprocating movement on the printing paper 1 under the guidance of a guide rail 130. In addition, a paper transporting mechanism (not shown) is also installed in the ink jet printer 100, so that the printing paper 1 is transported little by little according to the movement in which the carriage 110 reciprocatively moves. Next, according to the movement in which the carriage 110 reciprocatively moves and the movement in which the printing paper 1 is transported, the image is printed on the printing paper 1 by ejecting C color ink (hereinafter, referred to as C ink), Y color ink (hereinafter, referred to as Y ink), M color ink (hereinafter, referred to as M ink), or K color ink (hereinafter, referred to as K ink) from the ejection head 112.

The ink ejected from the ejection head 112 is contained in an ink tank 151 installed in the tank case 150. In the ink jet printer 100 according to the embodiment, four ink types of C ink, Y ink, M ink, and K ink are used, so that the ink tanks 151 corresponding to the ink types are also installed. In other words, the four ink tanks 151 of an ink tank 151C for C ink, an ink tank 151Y for Y ink, an ink tank 151M for M ink, and an ink tank 151K for K ink are installed. In addition, in this specification, particularly, in the case where it is unnecessary to distinguish the ink types, the ink tanks 151C, 151Y, 151M, and 151K corresponding to the ink types may be collectively referred as the ink tanks 151. The ink in the ink tanks 151 is supplied to the ejection heads 112 corresponding to the ink types through ink tubes 117 corresponding to the ink types.

Furthermore, an area called a home position is disposed at the position where the carriage 110 is moved along the guide rail 130 to the outer side of the printing paper 1, and during the period when the ink jet printer 100 does not print an image, the carriage 110 is moved to be located at the home position. A cap 122 is disposed at the home position. The cap 122 is configured to be movable in the upward and downward directions by a lifting mechanism (not shown). Next, in the state that the carriage 110 is moved to be located at the home position, if the lower surface side of the carriage 110 is pressed by the cap 122, a closed space is formed to cover the ejection head 112, so that it is possible to prevent the ink in the ejection head 112 from being dried. In addition, the cap 122 is connected through a negative pressure tube 124 to a negative pressure pump 120. In the state the lower surface side of the carriage 110 is pressed by the cap 122, the negative pressure pump 120 is operated, so that it is possible to suck out the ink in the ejection head 112. Therefore, in the case where a viscosity of ink is increased due to the progression of drying in the ejection head 112, the ink is sucked out, so that it is possible to maintain an appropriate viscosity of the ink in the ejection head 112.

In addition, the ink jet printer 100 includes a controller 140 configured with a CPU which performs logic calculation or arithmetic calculation, an ROM which stores various types of programs or data, a RAM in which data are temporarily stored by the CPU, and the like. If the controller 140 receives image data which are subject to an image process from the computer 200, the controller 140 converts an image represented by the image data into image data (dot data) represented by ink dots. Next, according to the dot data, an operation in which the carriage 110 performs the reciprocating movement, an operation in which the printing paper 1 is transported, and an operation in which the ejection head 112 ejects ink to form dots are controlled. In addition, if the ink dots are formed, the ink amount corresponding to the formed ink dots is consumed, so that the remaining ink amount in the ink tank 151 is decreased. Therefore, in the controller 140 according to the embodiment, the remaining ink amount in the ink tank 151 corresponding to the ink types is counted based on the dot data corresponding to the ink types. If the remaining ink amount reaches a predetermined lower limit value (predetermined limit value) (if the ink is used up), the operation for ejecting ink from the ejection head 112 is stopped. By doing so, it is possible to prevent the ejection head 112 from be greatly damaged due to the driving of the ejection head 112 in the state where the ink is not supplied.

The computer 200 is configured so that the CPU, the ROM, the RAM, and the like are connected to each other via a bus so as to communicate data, so that the computer 200 executes various types of programs stored in the ROM. In addition, the computer 200 also includes a monitor screen 202. Among a plurality of the programs stored in the ROM, a program called a printer driver 204 is stored. If the CPU executes the printer driver 204, a predetermined image process is performed on the image data which are to be printed, and the image data are output to the ink jet printer 100.

In addition, if the operations of the printer driver 204 according to the embodiment are classified according to the function, the operations may be classified into a portion (image conversion module) relating to the function for performing an image process on the image data, a portion (remaining ink amount management module) relating the function for managing the remaining ink amount of the ink tank 151 by a communication function unit which communicates with the ink jet printer 100, a portion (ink refilling module) relating to the function for being driven by the remaining ink amount management module to supplement ink to the ink tank 151, and the like. In addition, the term "module" is a virtual concept of the operation of the printer driver 204 as roughly classified according to the function. Practically, the module may be embodied by various forms. For example, the module may be embodied as a program code group in which a plurality of commands are arranged so as to embody a desired function or an LSI group in which the desired function is embodied in a hardware manner.

As described above, although the image conversion module performs a predetermined image process on the image data of the to-be-printed image and outputs the image data to the ink jet printer 100, since the process is the same as a process which is generally performed by the printer driver, the description of the process is omitted herein. In addition, in the printer driver 204 according to the embodiment, the remaining ink amount management module (or the ink refilling module) communicates data with the ink jet printer 100 and performed the remaining ink amount management process described hereinafter, so that the problem that the ink jet printer 100 may not proceed printing due to the occurrence of ink disconnection is avoided. Furthermore, the problem that clogging occurs in an inner portion of the ejection head 112 due to the refilling of the ink having an inappropriate property and state is avoided. Hereinafter, in order to embody this function, the process performed by the remaining ink amount management module inside the printer driver 204 according to the embodiment is described.

B. Remaining Ink Amount Management Process

Figure 3:
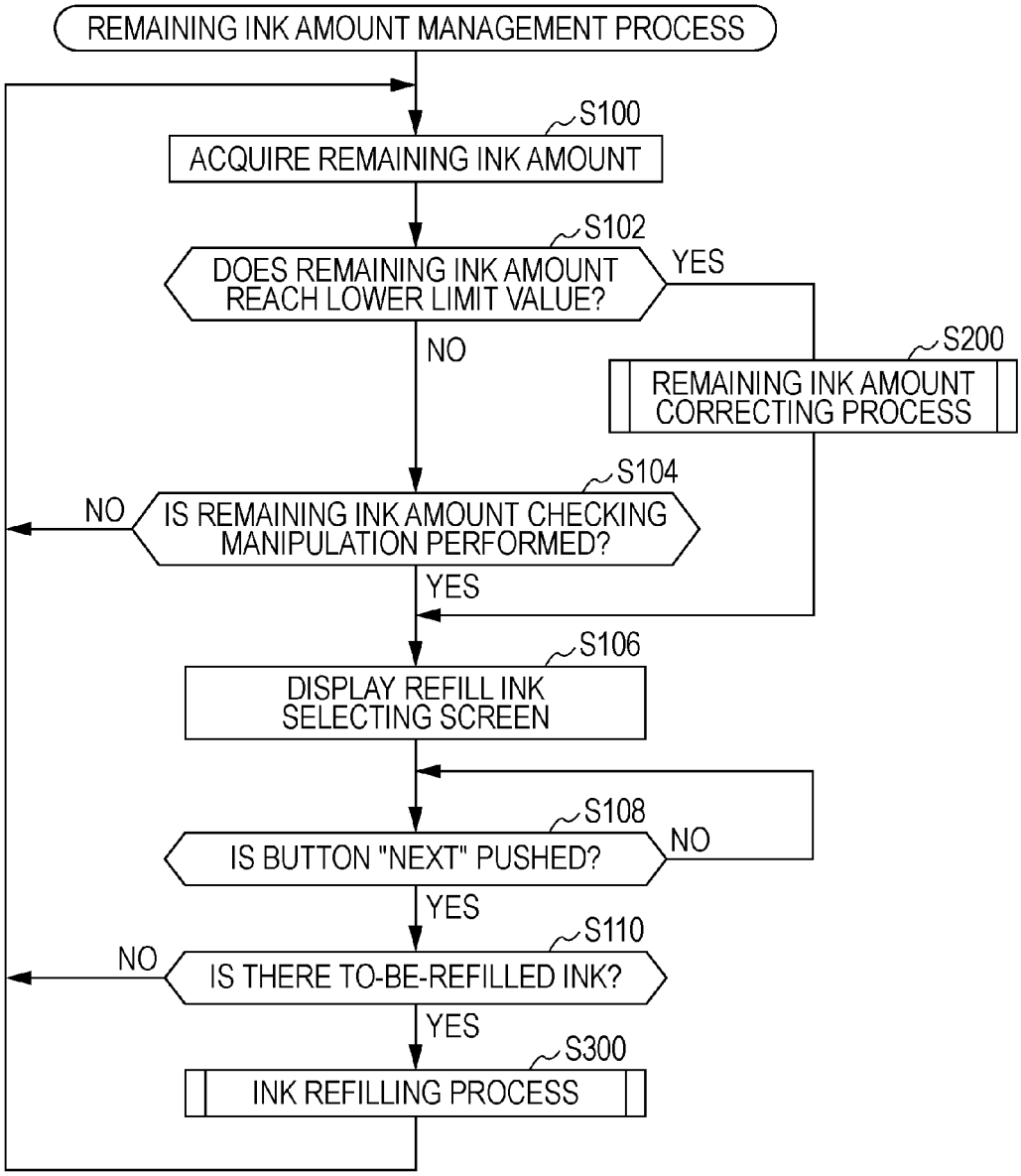
FIG. 3 is a flowchart illustrating a remaining ink amount management process performed by a printer driver according to an embodiment of the invention.

FIG. 3 is a flowchart illustrating a remaining ink amount management process performed by the printer driver 204 according to the embodiment of the invention. The process is the process performed by the remaining ink amount management module of the printer driver 204 while communicating with the controller 140 of the ink jet printer 100.

As illustrated in FIG. 3, in the remaining ink amount management process, first, the remaining ink amount in the ink tank 151 corresponding to the ink types is acquired from the controller 140 of the ink jet printer 100 (Step S100). As described above with reference to FIG. 2, the controller 140 of the ink jet printer 100 converts the image data received from the computer 200 into dot data (the image data representing the image with ink dots) to control operations or the like of the ejection head 112 or the carriage 110 and counts the remaining ink amount of the ink tank 151 corresponding to the ink types based on the dot data. The counted remaining ink amount is stored in the RAM or the ROM of the ink jet printer 100. In addition, the processes hereinafter are performed with respect to the ink of each of all the colors. Therefore, if a type of the ink is not particularly specified, the description pertains to all the ink.

If the remaining ink amount is acquired from the controller 140 of the ink jet printer 100, it is determined whether or not the acquired remaining ink amount reaches a predetermined lower limit value (Step S102). As a result, in the case where the remaining ink amount of any one of the ink tanks 151 is decreased to the predetermined lower limit value (Step S102: yes), the remaining ink amount correcting process is started (Step S200). More specifically, although described later, the remaining ink amount correcting process is a process of allowing the manipulator of the ink jet printer 100 to check the remaining ink amount of the ink tank 151 and correcting the remaining ink amount of the ink jet printer 100 in the case where ink does yet remain actually.

On the other hand, in the case where the remaining ink amount acquired from the ink jet printer 100 doe not yet reach the lower limit value (Step S102: no), it is determined whether or not a predetermined manipulation for checking the remaining ink amount is performed by the manipulator of the ink jet printer 100 (Step S104). The predetermined manipulation for checking the remaining ink amount is, for example, a manipulation by which the manipulator selects an icon of the ink jet printer 100 from the computer 200 and allows the properties to be displayed. As a result, in the case where the manipulation for checking the remaining ink amount is not performed (Step S104: no), the procedure returns to the starting position of the process to acquire the remaining ink amount from the ink jet printer 100 again (Step S100), and after that, a series of the aforementioned processes are repeated.

On the contrary, in the case where the predetermined manipulation for checking the remaining ink amount is performed by the manipulator of the ink jet printer 100 (Step S104: yes), a screen for selecting the ink for refilling the ink tank (refilling ink) is displayed on the monitor screen 202 of the computer 200 (Step S106).

Figure 4:
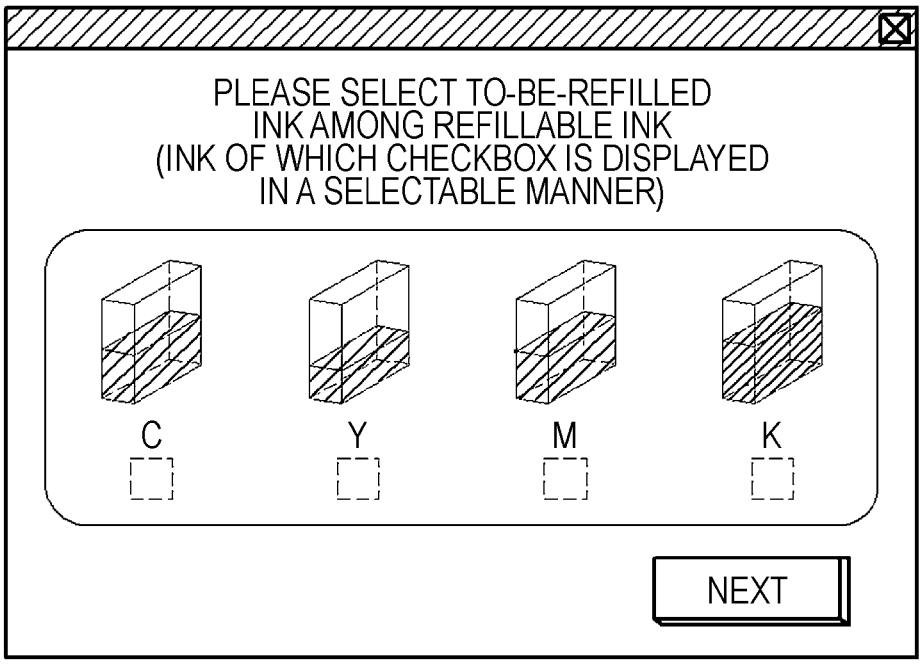
FIG. 4 is a diagram illustrating an example of a refill ink selecting screen displayed on a monitor screen.

FIG. 4 is a diagram illustrating an example of a refill ink selecting screen (including a remaining ink amount checking screen) displayed on the monitor screen 202. As illustrated, on the refill ink selecting screen, the image showing the rough remaining ink amount is displayed with respect to each of the C ink, the Y ink, the M ink, and the K ink. The remaining ink amount is displayed based on the remaining ink amount acquired from the ink jet printer 100. In addition, a check box is displayed under the image showing the rough remaining ink amount, so that the refill ink may be selected by the manipulator of the ink jet printer 100 checking the checkbox. Moreover, with respect to the ink of which the remaining ink amount is not decreased, it is not necessary to refill the ink tank with the ink. In addition, with respect to such ink, the checkbox is displayed in such a manner that the checkbox is not selectable. In FIG. 4, the checkboxes for ink of C, Y, M, and K are illustrated by broken lines. This denotes that the checkboxes may not be selected.

Figure 5:
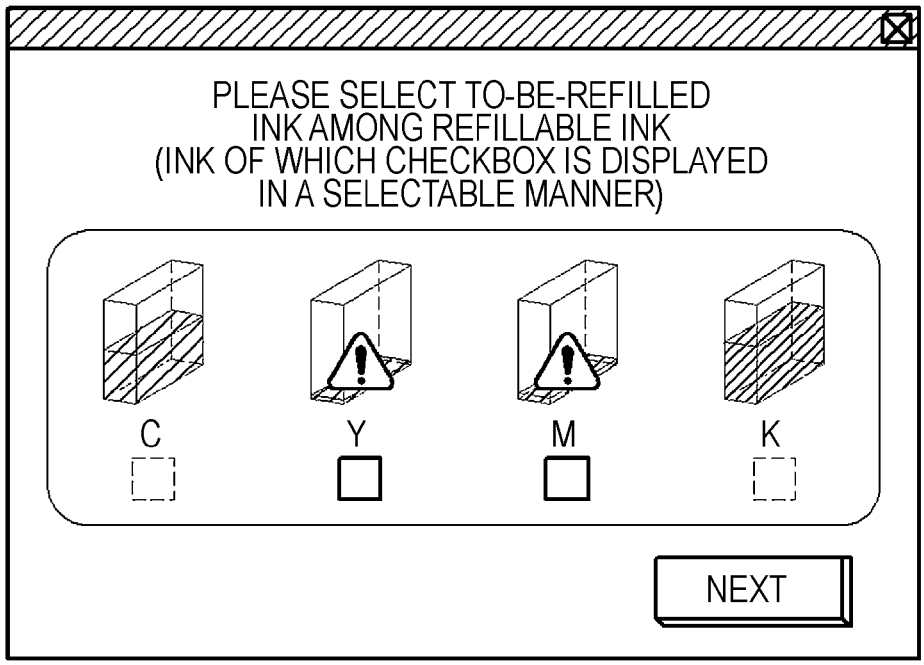
FIG. 5 is a diagram illustrating an example of another aspect of the refill ink selecting screen displayed on the monitor screen.

FIG. 5 is a diagram illustrating an example of another aspect of the refill ink selecting screen displayed on the monitor screen 202. In the example illustrated in FIG. 5, with respect to the Y ink and the M ink, the remaining ink amounts are decreased to a predetermined value (for example, 3% or less), so that the checkboxes of the ink are illustrated in a selectable manner. In this figure, the checkboxes are illustrated by solid lines. This denotes that the checkboxes may be selected. In addition, with respect to the ink of the remaining ink amount is described to be equal to or smaller than the predetermined value, a figure as an insertion of a symbol ! in a triangle is overlappedly illustrated on the image showing the rough remaining ink amount, so that it may be easily recognized that the remaining ink amount is decreased. In addition, in FIG. 5, although the case where the remaining ink amounts of the Y ink and the M ink are decreased to be equal to or smaller than the predetermined value is illustrated, in the case where the remaining ink amount of another ink (for example, the C ink) is decreased to be equal to or smaller than the predetermined value, the checkbox for the ink (C ink) is illustrated in the selectable manner, and the figure as an insertion of a symbol ! in a triangle is overlappedly illustrated on the image showing the rough remaining ink amount of the ink (C ink).

As described hereinbefore, in the remaining ink amount management process illustrated in FIG. 3, if the manipulator of the ink jet printer 100 performs the predetermined manipulation for checking the remaining ink amount (Step S104: yes), in the case where there is no ink of which the remaining ink amount is decreased to be equal to or smaller than the predetermined value at this time, the refill ink selecting screen is displayed in the manner illustrated in FIG. 4. On the contrary, in the case where there is ink of the remaining ink amount is decreased to be equal to or smaller than the predetermined value, the refill ink selecting screen illustrated in FIG. 5 is displayed (Step S106). Next, in the case where the refill ink selecting screen is displayed in the manner illustrated in FIG. 4, since the checkbox of any ink is not displayed in the selectable manner, the manipulator of the ink jet printer 100 selects the button (hereinafter, referred to as the button "Next") which is displayed as "Next" at the lower right corner of the screen. On the contrary, in the case where the refill ink selecting screen is displayed in the manner illustrated in FIG. 5, after the manipulator of the ink jet printer 100 checks the checkbox of the ink which is considered to be used for the refilling, the button "Next" at the lower right corner of the screen is selected. Naturally, in the case where the manipulator of the ink jet printer 100 does not consider refilling any ink, the checkbox of any ink is not checked, and the button "Next" is selected.

In the remaining ink amount management process of FIG. 3, if the refill ink selecting screen illustrated in FIG. 4 or FIG. 5 is displayed on the monitor screen 202 (Step S106), until the button "Next" is clicked by the manipulator of the ink jet printer 100, "no" is determined in Step S108, so that the stand-by state is maintained. Next, if the button "Next" is pushed by the manipulator of the ink jet printer 100, the remaining ink amount management module of the printer driver 204 detects this (Step S108: yes), at this time, it is determined whether or not the ink which is selected so as to be used for the refilling (the ink of which the checkbox on the refill ink selecting screen may be checked) exists (Step S110). As a result, in the case where the ink which is to be used for the refilling exists (Step S110: yes), the later-described ink refilling process is started (Step S300).

On the contrary, in the case where the refill ink selecting screen is displayed in the non-selectable manner as illustrated in FIG. 4 or in the case where, although the refill ink selecting screen is displayed in the selectable manner, any ink is not selected as illustrated in FIG. 5, in Step S110, it is determined that the ink which is to be used for the refilling does not exist (Step S110: no). Next, in this case, without performing the later-described ink refilling process, the procedure returns to the starting portion of the remaining ink amount management process, and the remaining ink amount is acquired from the ink jet printer 100 (Step S100). And, after that, a series of the aforementioned processes are repeated.

Hereinbefore, the process of displaying the refill ink selecting screen in the case where the manipulator of the ink jet printer 100 performs the predetermined manipulation for checking the remaining ink amount (Step S104: yes) is described. In this manner, the manipulator of the ink jet printer 100 performs the predetermined manipulation to open the refill ink selecting screen on the monitor screen 202 of the computer 200 irrespective of the value of the remaining ink amount acquired from the ink jet printer 100, so that the rough remaining ink amount may be displayed at any time. On the contrary, in the case where the remaining ink amount acquired from the ink jet printer 100 is determined to reach the predetermined lower limit value (Step S102: yes), the remaining ink amount correcting process hereinafter described is started (Step S200), so that the screen for displaying the rough remaining ink amount is automatically displayed. Hereinafter, the remaining ink amount correcting process is described.

Figure 6:
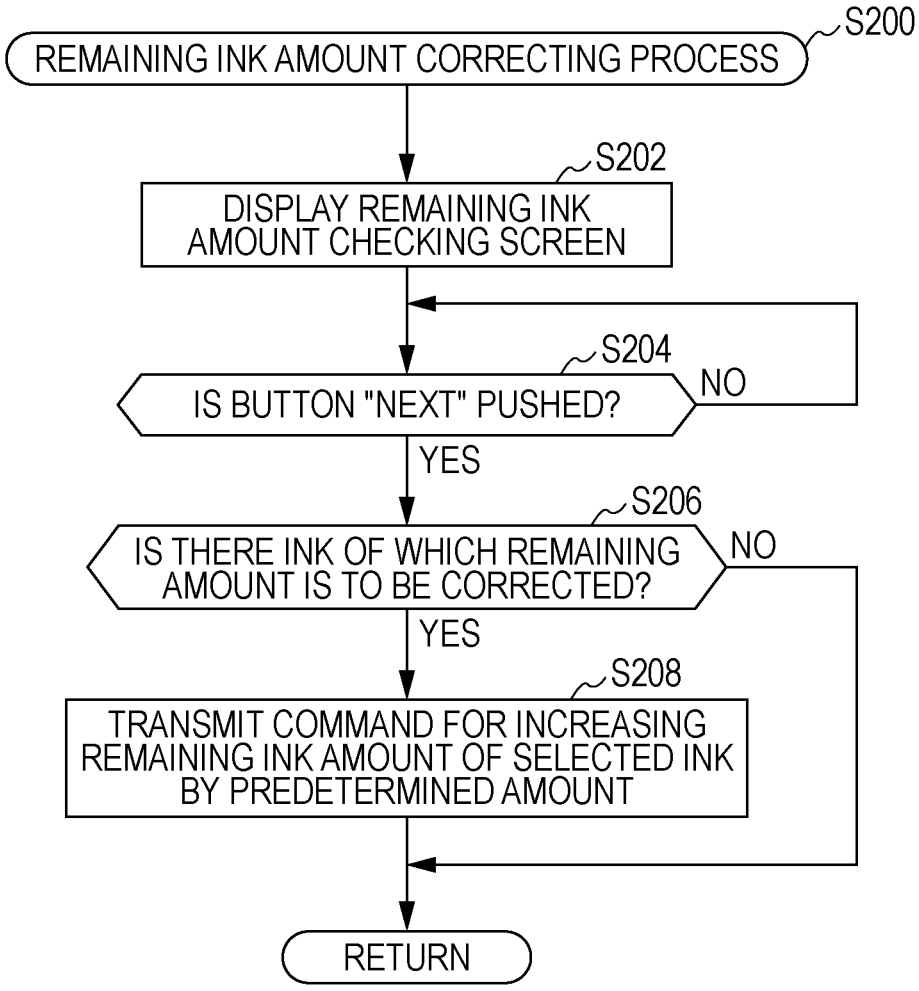
FIG. 6 is a flowchart illustrating a remaining ink amount correcting process performed in the remaining ink amount management process.

B-1. Remaining Ink Amount Correcting Process:

FIG. 6 is a flowchart illustrating the remaining ink amount correcting process. As described above, the process is a process in the remaining ink amount management process, which is performed by the remaining ink amount management module (refer to FIG. 2) of the printer driver 204 in the case where the remaining ink amount of any ink is determined to reach the predetermined lower limit value (Step S102 of FIG. 3: yes).

As illustrated in FIG. 6, if the remaining ink amount correcting process is started, first, the remaining ink amount checking screen is displayed on the monitor screen 202 of the computer 200 (Step S202). Herein, the remaining ink amount checking screen is a screen for prompting the manipulator of the ink jet printer 100 to visually observe the ink surface of the ink tank 151 to check the remaining ink amount which actually remains. Details of the remaining ink amount checking screen are described later.

In addition, due to the following reason, the manipulator of the ink jet printer 100 is allowed to check the remaining ink amount by visual observation. First, the remaining ink amount acquired from the ink jet printer 100 by the printer driver 204 is a remaining ink amount which is obtained by calculating the ejection amount of ink (ink ejection amount) based on the dot data and accumulating the ink ejection amount in the controller 140 of the ink jet printer 100. However, since the actual ink ejection amount is changed according to the environment (for example, the ambient temperature or the like) where the ink jet printer 100 is used, some error is included in the calculational ink ejection amount. Therefore, due to the accumulation of the error, the remaining ink amount obtained through the calculation may not be coincident to the actual remaining ink amount. Accordingly, if the calculational remaining ink amount reaches the lower limit value, it is checked whether or not the actual remaining ink amount reaches the lower limit value by checking through visual observation whether or not the ink surface of the ink tank 151 is actually decreased to the lower limit line.

Figure 7:
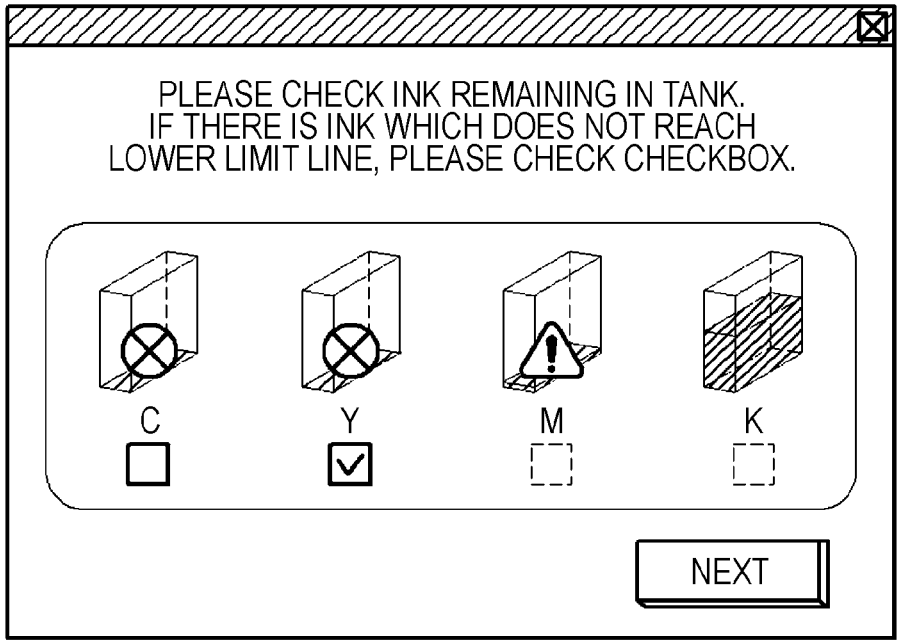
FIG. 7 is a diagram illustrating an example of a remaining ink amount checking screen displayed on the monitor screen.

FIG. 7 is a diagram illustrating an example of the remaining ink amount checking screen displayed on the monitor screen 202. As illustrated, similarly the refill ink selecting screen described with reference to FIG. 4 or 5, with respect to each of the C ink, the Y ink, the M ink, and the K ink, the image showing the rough remaining ink amount is displayed on the remaining ink amount checking screen.

Next, by checking the image showing each of the remaining ink amounts, it may be easily checked whether or not the remaining ink amount reaches the lower limit value. For example, a figure as an insertion of a symbol x in a circle is overlappedly illustrated on the image showing the remaining ink amount of the C ink and the image showing the remaining ink amount of the Y ink illustrated in FIG. 7, so that it is indicated that the remaining ink amounts of the ink are decreased to the lower limit value (the ink tanks 151 are almost empty). In addition, the figure as an insertion of the symbol ! in the triangle is overlappedly illustrated on the image showing the remaining ink amount of the M ink. Similarly to the refill ink selecting screen described above with reference to FIG. 5, this indicates that the remaining ink amount is decreased to the level of which the ink may be used for the refilling. Furthermore, with respect to the image showing the remaining ink amount of the K ink, any figures are not overlapped illustrated thereon. This indicates that, with respect to this ink, the remaining ink amount is not decreased to the level of which the ink may be used for the refilling.

In addition, rectangular checkboxes are illustrated below the images showing the remaining ink amounts of the ink. Furthermore, above the images showing the remaining ink amounts, a message "Please check ink amounts remaining in the ink tanks 151 and, if there is the ink which is not yet decreased to the lower limit line, please check the checkbox" is illustrated. As described above with reference to FIG. 1, although the ink tanks 151 are contained inside the tank case 150, the later-described checking window is disposed to the tank case 150. Therefore, the manipulator of the ink jet printer 100 may easily check the remaining ink amount in each of the ink tanks 151.

Figure 8:
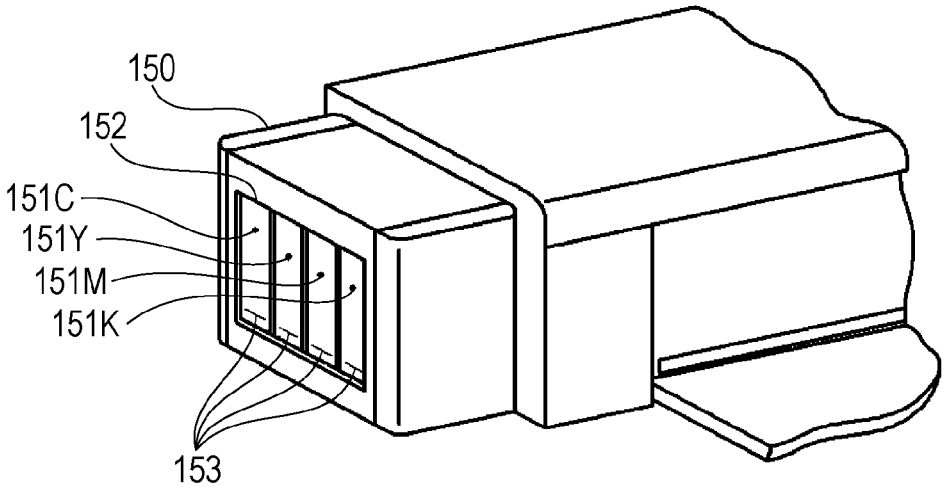
FIG. 8 is a diagram illustrating a behavior of checking a remaining ink amount of an ink tank from a checking window of a tank case.

FIG. 8 is a diagram illustrating a behavior of checking the remaining ink amount of the ink tank 151 from a checking window 152 of the tank case 150. As illustrated, a large checking window 152 is disposed on the side surface of the tank case 150, each of the ink tank 151C of C ink, the ink tank 151Y of Y ink, the ink tank 151M of M ink, and the ink tank 151K of K ink included in the tank case 150 may be visually observed. In addition, each of the ink tanks 151C, 151Y, 151M, and 151K is made of a transparent or semi-transparent resin material. Therefore, the position of the ink surface remaining in each of the ink tanks 151C, 151Y, 151M, and 151K may be checked through visual observation.

In addition, as illustrated in FIG. 8, the lower limit line 153 is displayed in each of the ink tanks 151C, 151Y, 151M, and 151K. The lower limit line 153 corresponds to the "lower limit value" which is determined with respect to the remaining ink amount in the remaining ink amount management process illustrated in FIG. 3. In other words, the lower limit line 153 is obtained by subtracting the ink ejection amount from the full tank state of the ink tank 151 based on the dot data and the lower limit line 153 is set to the position where the ink surface in the ink tank 151 is just decreased when the remaining ink amount is decreased to the lower limit value.

Accordingly, if the calculational remaining ink amount based on the dot data is determined to be decreased to the predetermined lower limit value, the remaining ink amount checking screen illustrated in FIG. 7 is displayed. In addition, the manipulator of the ink jet printer 100 checks the position of the ink surface in each of the ink tanks 151 from the checking window 152, so that the actual remaining ink amount may be checked. As a result, in the case where, although the remaining ink amount is decreased to the lower limit value in terms of the calculation (in other words, the ink surface is considered to reach the lower limit line 153), the ink surface does not yet reach the lower limit line 153 actually, the checkbox of the corresponding ink is configured so as to be checked on the screen of FIG. 7.

In the example illustrated in FIG. 7, the inks of which the calculational remaining ink amount is less than the lower limit value is two inks of the C ink and Y ink, and only the checkboxes of the inks are displayed in the selectable manner that the checkboxes may be checked. On the contrary, with respect to the ink (the M ink and the K ink) of which the calculational remaining ink amount does not reach the lower limit value, the checkboxes are displayed in the non-selectable manner. In addition, with respect to the Y ink among the C ink and the Y ink, the ink surface which is actually checked does not reaches the lower limit line 153, so that the checkbox is checked. By doing so, the manipulator of the ink jet printer 100 checks the position of each of the ink surfaces from the checking window 152 of the tank case 150 through visual observation and checks the checkbox based on the result thereof, and after that, clicks the button "Next" displayed below the screen.

By doing so, in the remaining ink amount correcting process illustrated in FIG. 6, it is determined that the button "Next" is pushed (Step S204: yes). In addition, after the remaining ink amount checking screen of FIG. 7 is displayed on the monitor screen 202 (Step S202), until the button "Next" is clicked by the manipulator of the ink jet printer 100 "no" is determined in Step S204, so that the stand-by state is maintained.

Next, if the button "Next" is pressed (Step S204: yes), it is determined whether or not the ink of which the calculational remaining ink amount is necessary to correct (that is, the ink of which the checkbox on the remaining ink amount checking screen of FIG. 7 is checked exists (Step S206). As a result, in the case where the ink of which the remaining ink amount is necessary to correct exists (Step S206: yes), a command is transmitted to the controller 140 of the ink jet printer 100, so that the remaining ink amount of the corresponding ink is increased by a predetermined amount (for example, an amount corresponding to 3% of the full tank state amount) (Step S208). By doing so, even in the case where deviation between the calculational remaining ink amount and the actual remaining ink amount remaining in the ink tank 151 occurs, the calculational remaining ink amount may be allowed to be close to the actual remaining ink amount. In the case where the ink of which the remaining ink amount is necessary to correct does not exist (Step S206: no), the remaining ink amount correcting process of FIG. 6 is immediately ended without the correction of the remaining ink amount, the procedure returns to the remaining ink amount management process of FIG. 3.

In addition, in the embodiment, the ink ejection amount of the ejection head 112 is estimated to be slightly larger than the actual amount, so that the calculational remaining ink amount is set so that the calculational remaining ink amount is always smaller than the remaining ink amount of the ink actually remaining in the ink tank 151. This is based on the consideration that the occurrence of the problem that the printing may not be performed due to ink exhaustion is securely avoided by prompting preparing the refilling ink rapidly from the stage where the ink does yet remains. Accordingly, in the remaining ink amount management process illustrated in FIG. 3, only in the case where the calculational remaining ink amount reaches the predetermined lower limit value (Step S102 of FIG. 3: yes), the remaining ink amount correcting process is started, so that the manipulator of the ink jet printer 100 is allowed to check the actual ink surface.

Moreover, there may also be a case where the calculational remaining ink amount is larger than the ink amount actually remaining in the ink tank 151. Therefore, irrespective of whether or not the ink surface is actually decreased to the lower limit line 153, in the case where the remaining ink amount does not yet reach the lower limit value on the remaining ink amount checking screen of FIG. 7, the manipulator of the ink jet printer 100 is allowed to decrease the calculational remaining ink amount on the monitor screen 202, so that the calculational remaining ink amount may be coincident with the actual remaining ink amount.

By doing so, after the remaining ink amount is corrected in the remaining ink amount correcting process of FIG. 7 (Step S208 in FIG. 7), if the procedure returns to the remaining ink amount management process of FIG. 3, the refill ink selecting screen is displayed on the monitor screen 202 of the computer 200 (Step S106 of FIG. 3). In other words, if the remaining ink amount reaches the lower limit value, the remaining ink amount checking screen of FIG. 7 is automatically displayed without manipulation of the manipulator of the ink jet printer 100. If the manipulator of the ink jet printer 100 selects the button "Next" at the lower right corner of the screen, at this time, the refill ink selecting screen is displayed.

Figure 9:
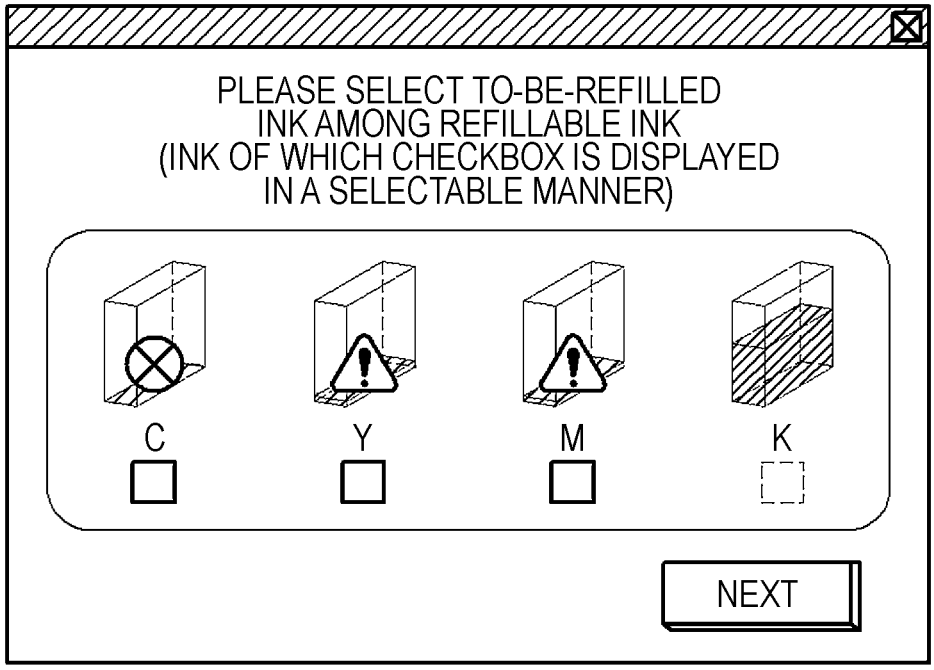
FIG. 9 is a diagram illustrating an example of a refill ink selecting screen displayed after the remaining ink amount checking screen.

FIG. 9 is a diagram illustrating an example of the refill ink selecting screen displayed after the remaining ink amount checking screen. The basic configuration of the refill ink selecting screen illustrated in FIG. 9 is the same as that of the refill ink selecting screen described above with reference to FIG. 4 or 5. However, since the refill ink selecting screen illustrated in FIG. 4 or 5 is the screen which is displayed by performing a predetermined manipulation of the manipulator of the ink jet printer 100 before the remaining ink amount reaches the lower limit value, with respect to any ink, the image (the image of the figure as an insertion of the symbol x in the circle) indicating that the remaining ink amount reaches the lower limit value is not displayed. On the contrary, on the refill ink selecting screen displayed after the remaining ink amount checking screen, as illustrated in FIG. 9, the image indicating that the remaining ink amount reaches the lower limit value may be displayed. This is because, according to the remaining ink amount checking screen illustrated in FIG. 7, the manipulator of the ink jet printer 100 checks the remaining ink amount through visual observation, and as a result, with respect to the ink of which the ink surface is decreased to the lower limit line 153, the checkbox for correcting the remaining ink amount is not selected, so that the refill ink selecting screen is displayed without correction of the remaining ink amount.

In the example illustrated in FIG. 9, with respect to the C ink, the checkbox may not be checked on the remaining ink amount checking screen of FIG. 7, and as a result, the image indicating that the remaining ink amount reaches the lower limit value is displayed on the refill ink selecting screen of FIG. 9. On the contrary, with respect to the Y ink, the checkbox may be checked on the remaining ink amount checking screen of FIG. 7, and as a result, the image is changed into the image (the image of the figure as an insertion of the symbol ! in the triangle) indicating that the remaining ink amount does not reach the lower limit value but the ink may be used for the refilling on the refill ink selecting screen of FIG. 9.

Next, as described above, the manipulator of the ink jet printer 100 checks the checkbox on the refill ink selecting screen of FIG. 9 to select the ink which is to be used for the refilling, and after that, if the button "Next" displayed at the lower right corner of the screen is selected, the remaining ink amount management module drives the ink refilling module. As a result, the ink refilling process (Step S300) for refilling the ink is started.

Figure 10:
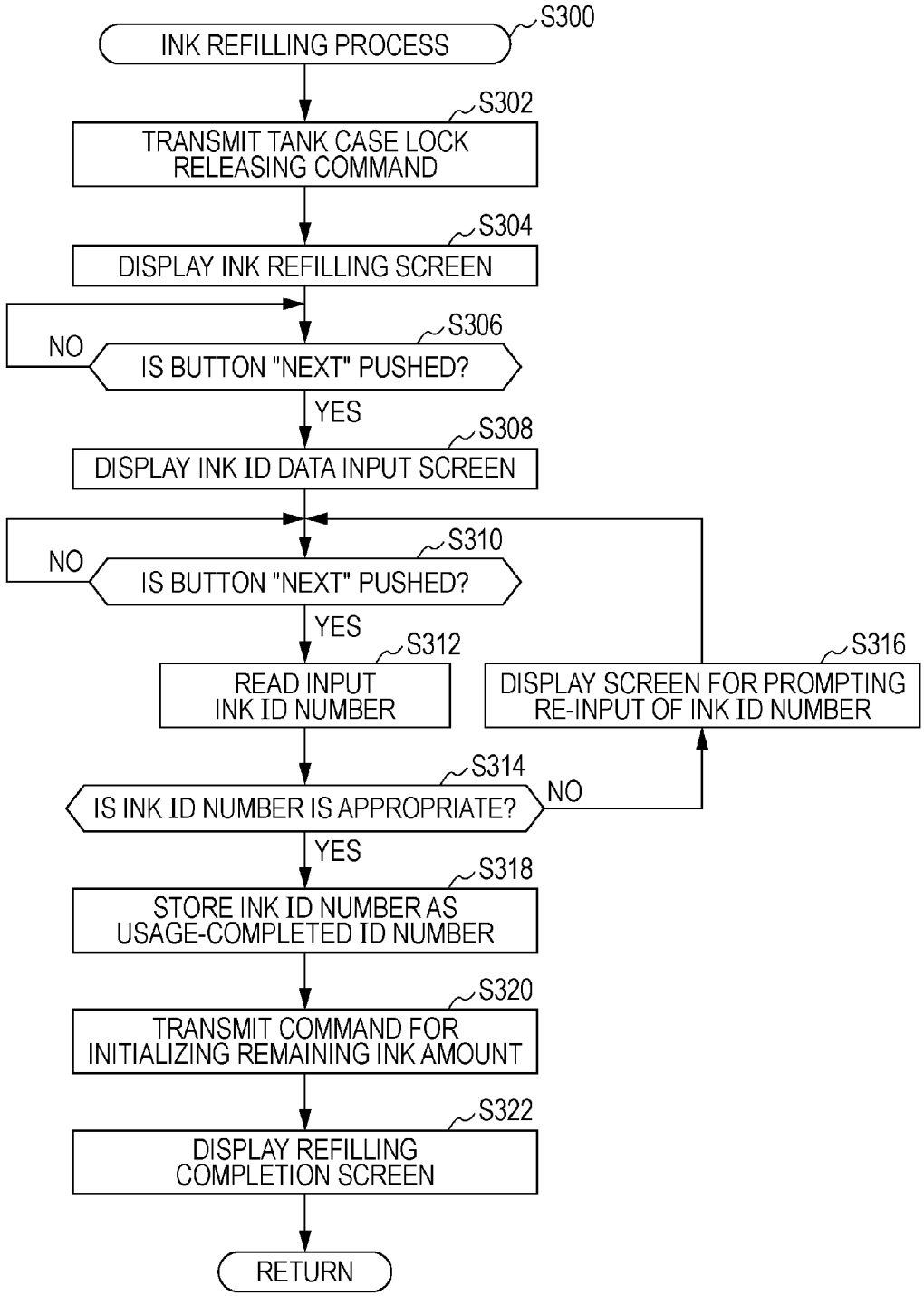
FIG. 10 is a flowchart illustrating an ink refilling process performed in the remaining ink amount management process.

B-2. Ink Refilling Process:

FIG. 10 is a flowchart illustrating the ink refilling process. The process is a process which is performed by the remaining ink amount management module and the ink refilling module installed in the computer 200 in the remaining ink amount management process. As illustrated, when the ink refilling process (Step S300) is started, first, the command (the lock release command) for releasing the lock of the tank case 150 is transmitted to the ink jet printer 100 (Step S302). This is performed due to the following reason.

As illustrated in FIG. 1, the tank case 150 is configured separately from the ink jet printer 100, so that the tank case 150 is used in the state that the tank case 150 is attached to the side surface of the ink jet printer 100. Next, at a normal time, the tank case 150 is in the state that the tank case 150 is locked not to be detached from the ink jet printer 100. However, in the state that the tank case 150 is attached to the ink jet printer 100, the ink tank 151 in the tank case 150 may not be refilled with ink. Therefore, at the time of refilling ink, in order to detach the tank case 150, a lock release command is transmitted from the computer 200 to the ink jet printer 100. If the controller 140 of the ink jet printer 100 receives the lock release command, an actuator (not shown) built in the ink jet printer 100 is driven, so that the locked state of the tank case 150 is released. As a result, the tank case 150 is in the state that the tank case 150 may be detached by the manipulator of the ink jet printer 100.

Figure 11:
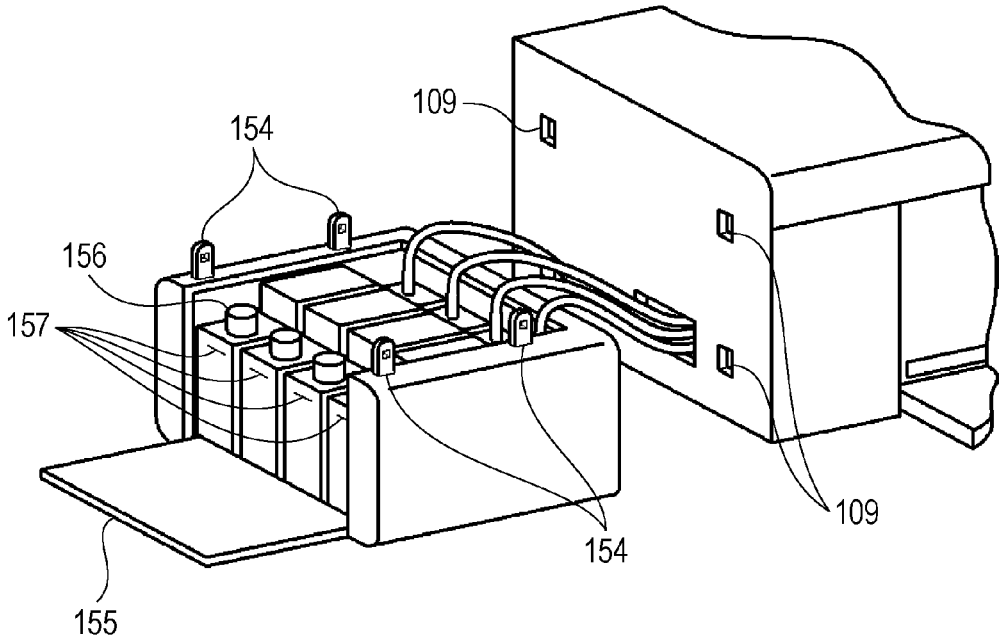
FIG. 11 is a diagram illustrating a behavior where the tank case is detached from the ink jet printer.

FIG. 11 is a diagram illustrating a behavior where the tank case 150 is detached from the ink jet printer 100. FIG. 11 illustrates the state where the tank case 150 is rotated so that, after the tank case 150 is detached, the surface of the side which is attached to the ink jet printer 100 is faced up. As illustrated, on the surface where the tank case 150 is attached to the ink jet printer 100, four small protrusions 154 are disposed to erect. In addition, on the surface of the ink jet printer 100, insertion holes 109 of the protrusions 154 are disposed at the corresponding positions.

In order to attach the tank case 150 to the ink jet printer 100, the positions of the protrusions 154 and the positions of the insertion holes 109 are aligned, and the protrusions 154 are inserted into the insertion holes 109. By doing so, small through hole portions formed in distal ends of the protrusions 154 are engaged with lock mechanisms (not shown) installed inside the insertion holes 109 so as to be in the locked state, so that the tank case 150 is in the attached state. In addition, in the state where the tank case 150 is detached, an upper cover 155 installed on the upper surface of the tank case 150 may be laid down. Next, if the upper cover 155 is laid down, as illustrated in FIG. 11, the ink tanks 151 appear. As a result, the upper limit lines 157 indicated on the side surfaces of the ink tanks 151 may be visually checked. Furthermore, as illustrated FIG. 11, the upper cover 155 is laid down in the state where the tank case 150 is rotated, so that caps 156 disposed on the upper surface sides of the ink tanks 151 may be easily detached.

If the printer driver 204 of the computer 200 releases the locked state of the tank case 150 by transmitting the lock release command to the ink jet printer 100 (Step S302 of FIG. 10), at this time, the ink refilling screen is displayed on the monitor screen 202 of the computer 200 (Step S304).

Figure 12:
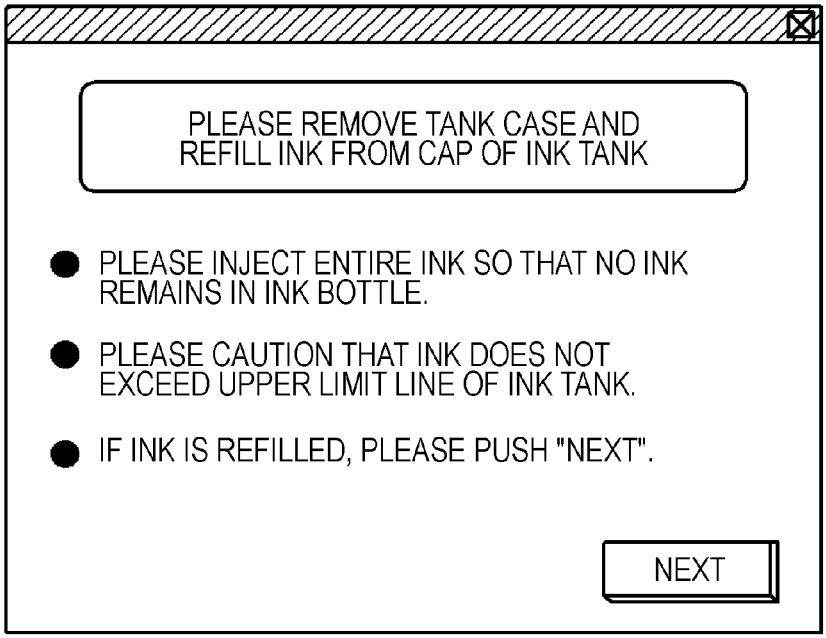
FIG. 12 is a diagram illustrating an example of an ink refilling screen displayed on the monitor screen.

FIG. 12 is a diagram illustrating an example of the ink refilling screen displayed on the monitor screen 202. As illustrated, the ink refilling screen indicates that the tank case 150 is detached and ink is prompted to be used for the refilling from the caps 156 (refer to FIG. 11) of the ink tanks 151. In addition, under this indication, cautions of the ink refilling time are illustrated as follows. The entire ink in the later-described ink bottle 160 is to be used for the refilling so that no ink remains in the ink bottle 160; and the ink surface it not to exceed the upper limit line 157 (refer to FIG. 11) marked on the ink tank 151.

Figure 13:
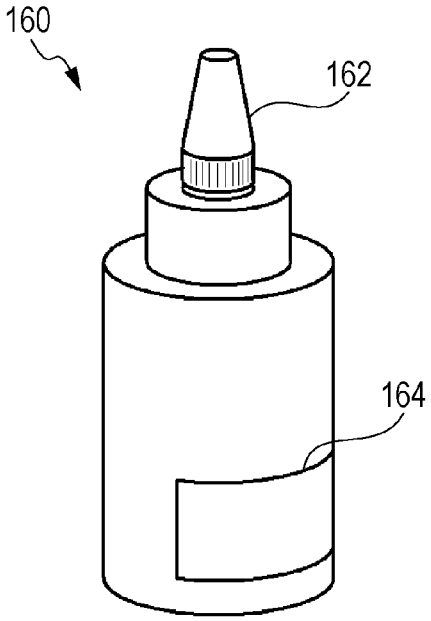
FIG. 13 is a diagram illustrating an example of an ink bottle where refill ink is contained.

FIG. 13 illustrates the ink bottle 160 where the ink for refilling is contained. The ink bottle 160 is a substantially cylindrical container made of a resin material having an excellent airtight property or an excellent light blocking property, and a cap 162 is disposed on top of the container. In addition, a label 164 made of a paper is attached on the side surface of the ink bottle 160, and the later-described ink ID number is printed on the outer side of the label 164.

With respect to the ink bottle 160 according to the embodiment, the cap 162 is mounted in the state where the cap 162 is fixed to the ink bottle 160, and in this state the inner portion of the ink bottle 160 is maintained in the airtight state. When the ink is to be used for the refilling, if the cap 162 is screwed to be detached, a slender spout appears therefrom. Next, as illustrated in FIG. 11, after the tank case 150 is detached, the cap 156 disposed to each of the ink tanks 151 is opened, and the ink of the ink bottle 160 is injected.

Herein, the ink amount in the ink bottle 160 is set to the ink amount so that, if the entire ink of the ink bottle 160 is injected in the state where the ink surface of the ink tank 151 is decreased to the lower limit line 153, the ink tank 151 is almost full. Furthermore, since the cap 162 of the ink bottle 160 is fixed to the ink bottle 160, once cap 162 is detached from the ink bottle 160, the cap 162 may not be attached thereto. Therefore, according to the caution indicating that the entire ink in the ink bottle 160 is to be used for the refilling on the ink refilling screen illustrated in FIG. 12, the manipulator of the ink jet printer 100 is naturally to refill the ink tank 151 with the entire ink of the ink bottle 160.

By doing so, if the entire ink which is to be necessarily used for the refilling is used for the refilling, the manipulator of the ink jet printer 100 selects the button "Next" displayed at the lower right corner of the ink refilling screen of FIG. 12. By doing so, in the ink refilling process of FIG. 10, it is determined that the button "Next" is pushed (Step S306: yes), and the screen for prompting inputting the ink ID number of the refilled ink is displayed on the monitor screen 202 (Step S308). In addition, after the ink refilling screen of FIG. 12 is displayed (Step S302), until the button "Next" is clicked by the manipulator of the ink jet printer 100, "no" is determined in Step S306, so that the stand-by is maintained.

Figure 14:
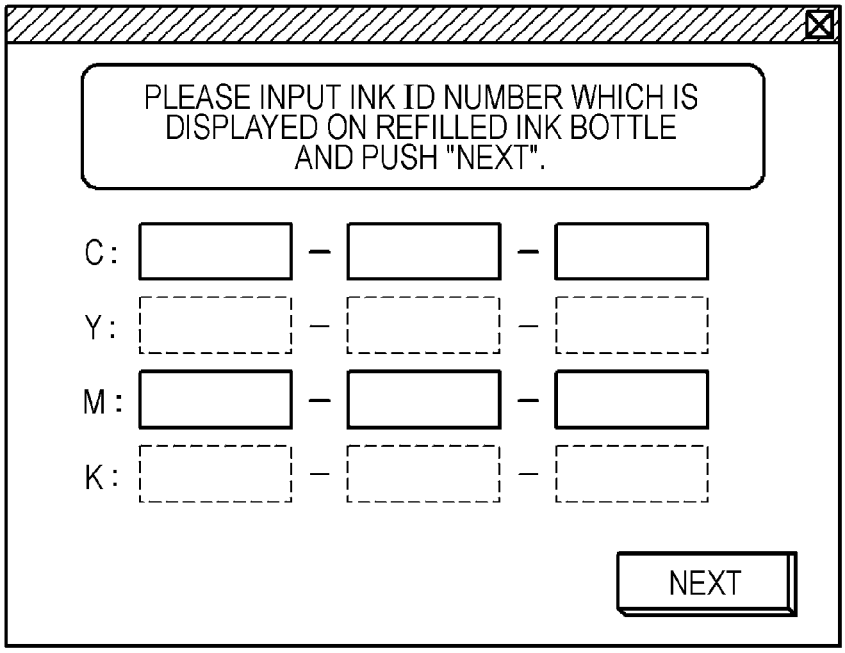
FIG. 14 is a diagram illustrating an example of an input screen displayed on the monitor screen so as to input an ink ID number.

FIG. 14 is a diagram illustrating an example of the ink ID number input screen displayed on the monitor screen 202. As illustrated, with respect to the ink which is determined to be necessarily used for the refilling by the aforementioned refill ink selecting process, an input column is displayed on the ink ID number input screen in the state where the ink ID number is inputtable. In the example illustrated in FIG. 14, the input columns of the C ink and the M ink are displayed in the state where the ink ID numbers are inputtable. In addition, with respect to the ink which is determined not to be necessarily used for the refilling (in this case, the Y ink and K ink), the input columns are displayed in the state where the ink ID numbers are non-inputtable. Therefore, the manipulator of the ink jet printer 100 checks the label 164 of the ink bottle 160 to input the ink ID number printed at the outer side of the label 164 and clicks the button "Next" displayed at the lower right corner of the screen.

By doing so, in the ink refilling process illustrated in FIG. 10, it is determined that the button "Next" is pushed (Step S310: yes), and after the input ink ID number is read (Step S312), it is determined whether or not the read ink ID number is appropriate (Step S314). Although the ink ID number is a seemingly meaningless code which is constructed with a plurality of numbers and alphabets, the ink ID number may be a kind of code data including information such as a type (color) of ink or a usable type of the ink jet printer 100. The ink ID number decoding unit in the ink refilling module decodes the ink ID number, so that the information may be acquired.

As a result, the ink refilling module normally completes the decoding of the ink ID number, and if various types of the obtained information (for example, the type of ink, the type of the ink jet printer 100, or the like) are correct, it may be determined that the ink ID number is appropriate. On the contrary, in the case where the ink ID number may not be decoded or in the case where the various types of the information obtained by the decoding are contradictory such as the case where, although the ink ID number may be decoded, for example, the type of ink or the type of the ink jet printer 100 is different from the actual one, it may be determined that the ink ID number is not appropriate. In Step S314 of the ink refilling process illustrated in FIG. 10, in this manner, it is determined whether or not the ink ID number is appropriate. In addition, although described later in detail, although the ink ID number is appropriate, in the case where the ink ID number which is used once is input again, it is determined that the ink ID number is not appropriate.

As a result, in the case where the input ink ID number is not appropriate (Step S314: no), the screen for prompting the re-input of the ink ID number is displayed on the monitor screen 202 (Step S316), and after that, the process (Step S310) for determining whether or not the button "Next" is pushed again is repeated, so that the stand-by state is formed.

Figure 15:
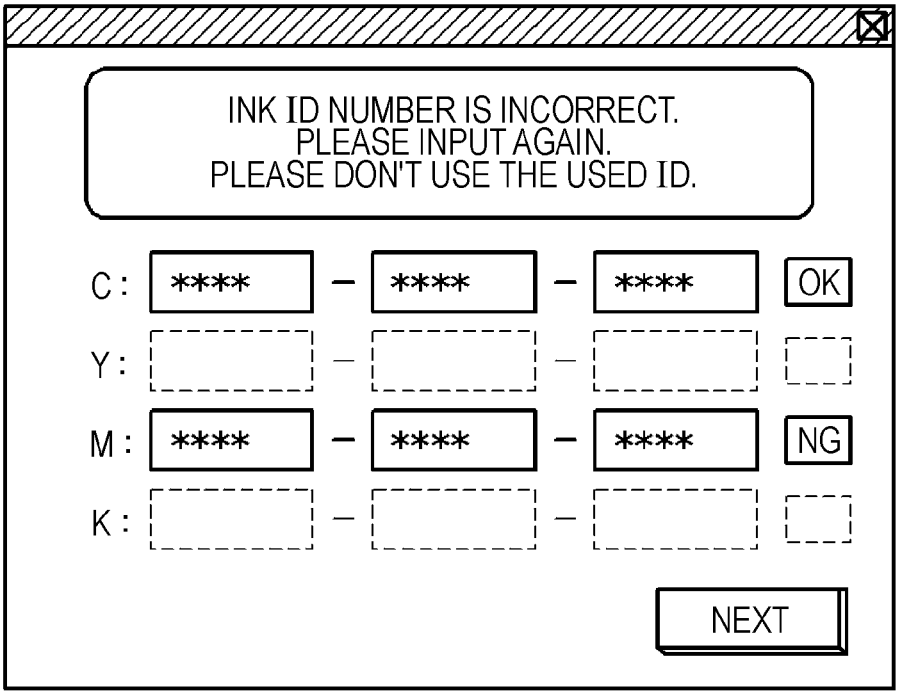
FIG. 15 is a diagram illustrating an example of a re-input screen displayed on the monitor screen so as to prompt re-inputting of the ink ID number.

FIG. 15 is a diagram illustrating an example of a screen (re-input screen) displayed on the monitor screen 202 so as to prompt re-inputting of the ink ID number. As illustrated, first, in addition to the input ink ID number, the result of determination whether or not the ink ID number is appropriate is displayed on the re-input screen. For example, in the example illustrated in FIG. 15, although the ink ID number input with respect to the C ink is determined to be appropriate, the ink ID number with respect to the M ink is determined not to be appropriate. Therefore, the manipulator of the ink jet printer 100 inputs the ink ID number of the M ink which is determined not to be appropriate again, and after that, clicks the button "Next" again. By doing so, the printer driver 204 determines that the button "Next" is pushed (Step S310 of FIG. 10: yes) and reads the re-input ink ID number (Step S312), and after that, it is determined whether or not the ink ID number is appropriate (Step S314).

As a result, if all the ink ID numbers are determined to be appropriate (Step S314: yes), at this time, the ink ID number which is determined to be appropriate is stored as the used ID number in the RAM (or the ROM) of the computer 200 (Step S316). By doing so, the stored used ID number is referred to in the process of Step S314 which determines whether or not the ink ID number is appropriate at the next time and the following times, so that the input ink ID number may be decoded correctly. In addition, although there is no contradiction in the decoded content, in the case where the used ID number is stored, it is determined that the ink ID number is not appropriate.

Subsequently, the ink refilling module transmits a command (initialization command) to the controller 140 of the ink jet printer 100 through the communication function unit of the remaining ink amount management module to initialize the calculational remaining ink amount, which is counted by the controller 140 of the ink jet printer 100, to the full tank state (Step S320). As described above with reference to FIG. 2, if the calculational remaining ink amount reaches the lower limit value, the controller 140 of the ink jet printer 100 stops the operation of ejecting ink with the ejection head 112. However, the controller 140 receives the initialization command from the printer driver 204 to initialize the calculational remaining ink amount, so that printing may be started again. In this manner, only in the case where the input ink ID number is appropriate, the remaining ink amount may be initialized. Therefore, the ink ID number corresponds to the "initialization data" according to the invention.

In addition, herein, the ink amount contained in the ink bottle 160 is set to the ink amount so that the ink surface of the ink tank 151 which is decreased to the lower limit line 153 almost reaches the upper limit line 157 if the entire ink in the ink bottle 160 is injected. Accordingly, in Step S320 of the ink refilling process of FIG. 10, if the ink refilling from the ink bottle 160 is completed, the calculational remaining ink amount is initialized to the full tank state. However, a plurality of types of the ink bottles 160 of which the amounts of contained ink are different are prepared, and the calculational remaining ink amounts may be set to different states according to the ink amounts contained in the ink bottles 160. In addition, the ink amount contained in the ink bottle 160 may be combined with the ink ID number printed on the label 164.

For example, as a result of decoding the input ink ID number, in the case where the ink ID number is the ink ID number of the ink bottle 160 of which the ink amount is largest, the calculational remaining ink amount is recovered to the full tank state. On the contrary, in the case where the ink ID number is the ink ID number of the ink bottle 160 of which the ink amount is small, the calculational remaining ink amount may be recovered to only about half of the full tank state. In the case where the ink ID number is the ink ID number of the ink bottle 160 of which has an intermediate ink amount, the calculational remaining ink amount may be recovered to only about ⅔ of the full tank state.

Figure 16:
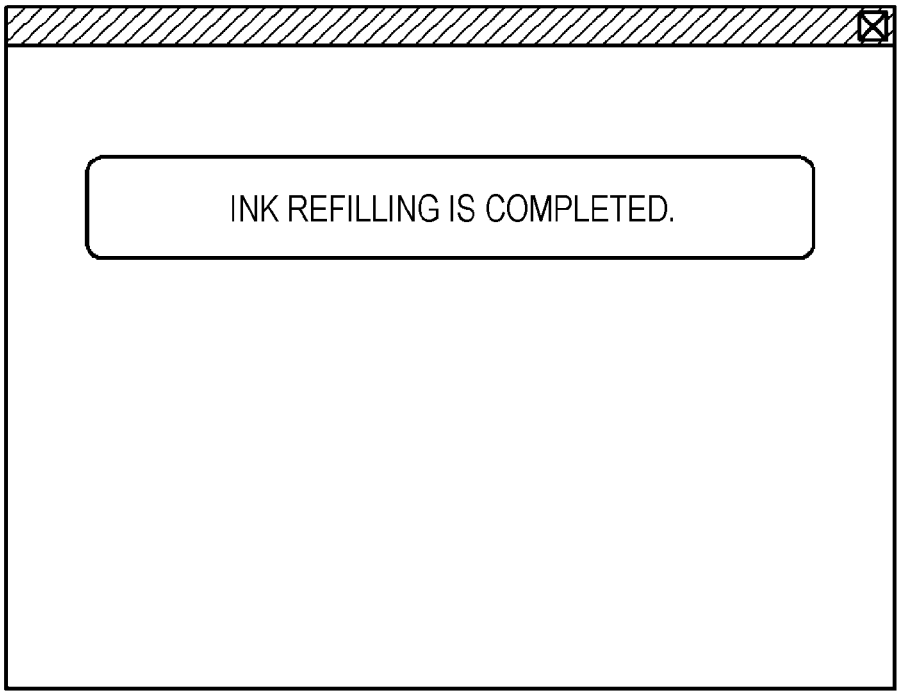
FIG. 16 is a diagram illustrating an example of a refilling completion screen displayed on the monitor screen.

By doing so, if the calculational remaining ink amount counted by the controller 140 of the ink jet printer 100 is recovered, at this time, the screen (the refilling completion screen) indicating that the ink refilling is completed is displayed on the monitor screen 202 (Step S322). FIG. 16 illustrates an example of the refilling completion screen displayed on the monitor screen 202 of the computer 200. By doing so, if the refilling completion screen is displayed, the ink refilling process illustrated in FIG. 10 is ended, and the procedure returns to the remaining ink amount management process of FIG. 3. After that, the procedure returns to the starting portion of the remaining ink amount management process, a series of the aforementioned processes are repeated.

As described hereinbefore, in the printing system 10 according to the embodiment, the controller 140 of the ink jet printer 100 counts the remaining ink amount based on the ink amount ejected from the ejection head 112. Next, while performing the aforementioned remaining ink amount management process, the printer driver 204 of the computer 200 acquires the remaining ink amount from the ink jet printer 100 to monitor the remaining ink amount in the ink tank 151. Next, if the remaining ink amount becomes small, the ink refilling process of FIG. 10 is performed to allow the manipulator of the ink jet printer 100 to refill the ink tank with the ink. Therefore, irrespective of employing not the type where the ink cartridge is replaced to refill the ink tank the ink but the type where the ink tank 151 is refilled with the ink from the ink bottle 160, it is possible to avoid the ink, of which the property and state are inappropriate, from being used for the refilling, so that the clogging occurs in the ejection head 112. Hereinafter, this point is described.

First, as described above with reference to FIG. 2, the controller 140 of the ink jet printer 100 counts the remaining ink amount based on the dot data, and if the counted remaining ink amount reaches the lower limit value, the controller 140 stops the operation of ejecting the ink with the ejection head 112. Accordingly, in order to continue to perform printing, it is necessary to initialize the remaining ink amount which is counted by the controller 140 of the ink jet printer 100. Therefore, it is necessary to refill the ink tank 151 with the ink. Next, if the manipulator of the ink jet printer 100 refills ink, the screen for inputting the ink ID number of the refilled ink is displayed on the monitor screen 202. It is determined by the printer driver 204 whether or not the input ink ID number is appropriate. Only in the case where the ink ID number is appropriate, the remaining ink amount is initialized, so that the ink may be ejected from the ejection head 112 again. In other words, although the ink tank 151 is refilled with the ink, if the appropriate ink ID number is not input, it is configured so that the ink in the ink tank 151 may not be ejected from the ejection head 112.

Next, as described above, since the ink ID number is code data where a plurality of numbers and alphabets are meaninglessly arranged, unless the ink ID number printed on the label 164 of the ink bottle 160 is referred to, it is, in fact, impossible to input the appropriate ink ID number. As a result, the manipulator of the ink jet printer 100 is naturally to purchase a genuine product (or a recommended product of a maker of the ink jet printer 100) of the ink bottle 160. Certainly, if the ink ID number of the genuine product of the ink bottle 160 which is purchased once is used several times, the refilling of the ink having an inappropriate property and state may not be avoided. However, the ink ID number which is accepted to be appropriate once is stored as the used ID number, so that when the ink ID number is input after that, the ink ID number is determined to be inappropriate. Therefore, in order to refill the ink tank with the ink, since the ink is necessarily used for the refilling from the genuine product (or a recommended product of a maker) of the ink bottle 160 which is newly purchased, the ink having an inappropriate property and state is supplied to the ejection head 112, so that it is possible to avoid the ejection head 112 from being clogged.

In addition, as described above with reference to FIGS. 4 and 5, in the printing system 10 according to the embodiment, if the ink surface in the ink tank 151 is decreased to the lower limit line 153, first, the screen for selecting to-be-refilled ink is displayed on the monitor screen 202 (refer to FIG. 5). Next, if the ink tank 151 is refilled with the entire ink in the ink bottle 160, the amount of ink contained in the ink bottle 160 is set so that the ink surface of the ink tank 151 reaches from the lower limit line 153 almost to the front of the upper limit line 157. Therefore, when the manipulator of the ink jet printer 100 is to refill the ink tank with the ink, the manipulator naturally refills the ink tank with the entire ink in the ink bottle 160. In addition, as illustrated in FIG. 12, since the message indicating that the entire ink in the ink bottle 160 is used for the refilling is displayed on the monitor screen 202, no ink is allowed to remain in the ink bottle 160.

As described above, even in the case of the genuine product of the ink bottle 160, if the product is opened, the deterioration of the property and state of the ink in the ink bottle 160 proceeds as time elapses. Accordingly, once the product is opened, the ink remaining in the ink bottle 160 may be used for the refilling, so that the inner portion of the ejection head 112 may be clogged. However, as described above, in the printing system 10 according to the embodiment, when the manipulator of the ink jet printer 100 refills the ink tank with the ink, no ink is allowed to remain in the ink bottle 160. Therefore, since the ink bottle 160 is opened, the deterioration of the ink in the ink bottle 160 proceeds, so that it is possible to avoid the clogging of the inner portion of the ejection head 112.

Moreover, as describe above, since the ink ID number which is input and received may not be used, at the next refilling time, a necessarily new ink bottle 160 is to be purchased, and if the entire ink in the ink bottle 160 is injected, the ink surface in the ink tank 151 almost reaches the upper limit line 157. In addition, as illustrated in FIG. 12, the caution indicating that the ink surface in the ink tank 151 is not to exceed the upper limit line 157 is displayed on the monitor screen 202. Therefore, although a small amount of the old ink remains in the ink bottle 160, it is possible to avoid the old ink from being used for the refilling in the ink tank 151 so that the ejection head 112 is clogged.

C. Modified Examples

There are several modified examples in the printing system 10 according to the aforementioned embodiment. Hereinafter, these modified examples are described in brief.

C-1. First Modified Example

In the printing system 10 according to the aforementioned embodiment, the lock release command of the tank case 150 is transmitted from the computer 200 to the ink jet printer 100, and the manipulator of the ink jet printer 100 detaches the tank case 150 and refills the ink tank 151 with the ink, and after that, the screen for inputting the ink ID number is displayed on the monitor screen 202 of the computer 200. In the case where the input ink ID number is not appropriate, since the remaining ink amount is not initialized, the ink is not sucked out from the ink tank 151. Accordingly, after a genuine product (or a recommended product of a maker) of the ink bottle 160 is purchased, the ink in the ink tank 151 is discarded, and the ink may be replaced with appropriate ink.

Moreover, before the lock release command of the tank case 150 is transmitted from the computer 200 to the ink jet printer 100, the screen for inputting the ink ID number is displayed, and in the case where the input ink ID number is determined to be appropriate, first, the lock release command of the tank case 150 may be transmitted. By doing so, since the tank case 150 may not detached if an appropriate ink ID number is not input, it is possible to avoid the ink tank 151 from being refilled with the ink having an inappropriate property and state.

C-2. Second Modified Example

In addition, in the printing system 10 according to the aforementioned embodiment, it is described that the ink tanks 151 of the ink colors are received in one tank case 150. Accordingly, when the tank case 150 is detached so as to refill some ink, the ink tank 151 of which the ink is not decreased to the refilling level may also be refilled with the ink at this refilling time.

Therefore, it may be configured that the ink tanks 151 of the colors are received in separate tank cases 150, so that the tank case 150 with respect to only the ink which is to be used for the refilling may be detached. Alternatively, although the ink tanks 151 of the colors are received in one tank case 150, when the ink is to be used for the refilling, the tank case 150 is not detached, but the ink tank 151 of which the ink is to be used for the refilling may be detached.

By doing so, it is possible to avoid another ink from being used for the refilling at the time of refilling the ink of which the refilling is necessary. In addition, since only the ink of which the refilling is necessary is in the state where the ink is refillable, it is possible to avoid an inappropriate ink tank 151 from being refilled with ink.

C-3. Third Modified Example

Figure 17A:
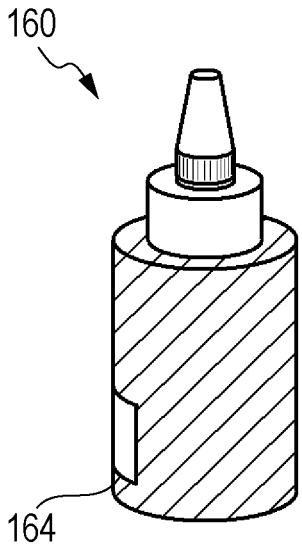
FIGS. 17A and 17B are diagrams illustrating an example of an ink bottle according to a third modified example.
Figure 17B:
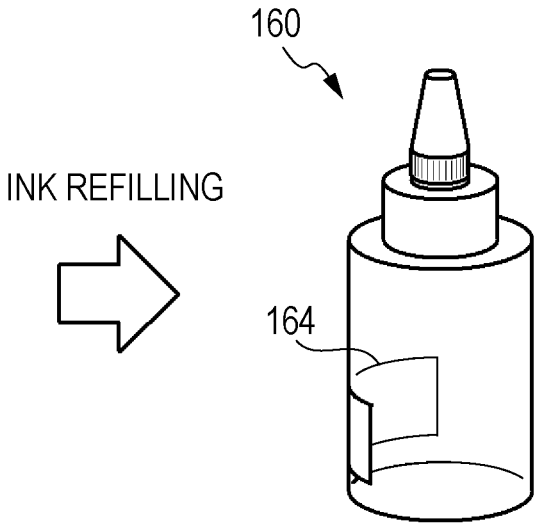

In the printing system 10 according to the aforementioned embodiment, it is described that the ink bottle 160 is made of an opaque material and the ink ID number is printed on the outer side of the label 164 attached on the ink bottle 160. However, at least a portion of the ink bottle 160 may be made of a transparent material, and the ink ID number may be printed on the inner side of the label 164 (that is, the surface of the side attached on the ink bottle 160). For example, a portion where the label 164 is attached on the ink bottle 160 and a portion facing the portion may be formed to be transparent. Next, as illustrated in FIGS. 17A and 17B, it may be configured that, the ink ID number may not read in the state where the ink is filled in the ink bottle 160, but the ink ID number printed on the inner side of the label 164 may be read if the ink in the ink bottle 160 is exhausted.

By doing so, since the ink ID number may first be read after the ink in the ink bottle 160 is used for the refilling, it is possible to reduce the possibility that the ink ID number of another ink bottle 160 is input by mistake.

C-4. Fourth Modified Example

In addition, in the printing system 10 according to the aforementioned embodiment, it is described that the printer driver 204 executes the remaining ink amount management process of FIG. 3 on the computer 200. However, since the controller 140 is configured with a CPU, a RAM, and a ROM, the monitor screen 104, the manipulation buttons 105, and the like are installed in the ink jet printer 100, it may be configured that the printer driver 204 executes the remaining ink amount management process of FIG. 3 on the ink jet printer 100.

Hereinbefore, although various embodiments are described, the invention is not limited to the aforementioned embodiments, but various aspects thereof may be embodied within the scope thereof without departing from the spirit thereof.

For example, in the aforementioned embodiment or modified examples, it is described that the ink amount ejected by the ejection head 112 according to the dot data is accumulated, so that the remaining ink amount is calculated. However, in order to maintain the appropriate property and state of the ink in the ejection head 112, there is a case of performing an operation (cleaning operation) of sucking out the ink of the ejection head 112 by using the cap 122 and the negative pressure pump 120. Even in the case where the cleaning operation is performed, since the ink is consumed, the remaining ink amount may be calculated by taking into consideration the consumed amount of the ink.

Alternatively, there is a case where the ejection head 112 ejects the ink while changing a plurality of the ejected ink amount levels. In this case, in addition to the ink ejection times, the remaining ink amount may be calculated by taking into consideration the ink amount of each of the ink ejection times.

The entire disclosure of Japanese Patent Application No. 2010-185849, filed Aug. 23, 2010 is expressly incorporated by reference herein.

What is claimed is:

1. A program for controlling operations of a printing apparatus by using a computer, the printing apparatus having an ink tank capable of being refilled with ink from an external portion and an ejection head of ejecting ink supplied from the ink tank, the printing apparatus having a function of stopping ink ejection from the ejection head if a count value of an ink amount supplied from the ink tank to the ejection head reaches a predetermined limit value, the program causing the computer to realize:

a first function of acquiring, from the printing apparatus, information capable of at least determining whether or not the count value of the ink amount reaches the limit value;

a second function of receiving an input of initialization data which are data for initializing the count value of the ink amount in the case where the count value of the ink amount reaches the limit value; and a third function of determining whether or not the input initialization data are appropriate, initializing the count value of the ink amount in the printing apparatus if the initialization data are determined to be appropriate, and storing the initialization data which are determined to be appropriate as inappropriate initialization data.

2. The program according to claim 1, wherein the second function is a function which embodies, by using the computer, functions including:

a sub function (2-1) of displaying a predetermined checking image for allowing a manipulator of the printing apparatus to check whether or not the refilling of the ink tank with the ink is performed if the count value of the ink amount reaches the limit value; and a sub function (2-2) of displaying a predetermined input image for allowing the manipulator to input the initialization data if it is detected that performing of the ink refilling is instructed by the manipulator of the printing apparatus.

3. The program according to claim 2, wherein the printing apparatus has a plurality of the ink tanks, the ejection heads provided to the ink tanks, and a function of stopping the ink ejection of each of the ink tanks if the ink amount counted from each of the ink tanks reaches the limit value, wherein the first function is a function of at acquiring information capable of at least determining whether or not the count value of the ink amount reaches the limit value with respect to each of the ink tanks, wherein the sub function (2-1) is a sub function of displaying the checking image with respect to the ink tank of which the count value of the ink amount reaches the limit value, and wherein the sub function (2-2) is a sub function of displaying the input image for inputting the initialization data with respect to the ink tank into which the performing of the ink refilling is instructed.

4. The program according to claim 3, wherein the plurality of ink tanks contain ink of different colors, and wherein the initialization data are data including ink color information.

5. A printing system having a printing unit which ejects ink refilled from an external portion into an ink tank by using an ejection head and a controller which controls operations of the printing unit, wherein the controller includes:

an ink amount counting unit for counting an ink amount supplied from the ink tank to the ejection head in the printing unit;

a unit for storing an accumulated amount of remaining ink or a consumed ink amount of the ink tank counted by the ink amount counting unit as a count value of the ink amount;

an ejection stopping unit for stopping the ink ejection from the ejection head if the count value of the ink amount reaches a predetermined limit value;

an initialization data receiving unit for receiving an input of initialization data for initializing the count value of the ink amount if the count value of the ink amount reaches the limit value; and an initialization data determining unit for determining whether or not the input initialization data are appropriate, initializing the count value of the ink amount if the initialization data are determined to be appropriate, and storing the initialization data which are determined to be appropriate as inappropriate initialization data.

* * * * *